US011971203B2

(12) United States Patent
Yoshimi et al.

(10) Patent No.: US 11,971,203 B2
(45) Date of Patent: Apr. 30, 2024

(54) APPARATUS, METHOD, AND PROGRAM FOR ESTIMATING AMOUNT OF REFRIGERANT

(71) Applicant: DAIKIN INDUSTRIES, LTD., Osaka (JP)

(72) Inventors: Manabu Yoshimi, Osaka (JP); Takeshi Hikawa, Osaka (JP); Shinichi Kasahara, Osaka (JP); Shohei Yamada, Osaka (JP); Hiroyuki Kagitani, Osaka (JP); Hidetaka Kishimoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/753,563

(22) PCT Filed: Jul. 29, 2020

(86) PCT No.: PCT/JP2020/029022
§ 371 (c)(1),
(2) Date: Mar. 8, 2022

(87) PCT Pub. No.: WO2021/049191
PCT Pub. Date: Mar. 18, 2021

(65) Prior Publication Data

US 2022/0268503 A1 Aug. 25, 2022

(30) Foreign Application Priority Data

Sep. 9, 2019 (JP) ..... 2019-163572

(51) Int. Cl.
*F25B 49/02* (2006.01)
*F24F 11/36* (2018.01)
*F24F 11/64* (2018.01)

(52) U.S. Cl.
CPC ..... *F25B 49/02* (2013.01); *F24F 11/36* (2018.01); *F24F 11/64* (2018.01);
(Continued)

(58) Field of Classification Search
CPC ..... F25B 49/02; F25B 2400/13; F25B 2600/2513; F25B 2700/21151;
(Continued)

(56) References Cited

U.S. PATENT DOCUMENTS

2007/0256432 A1* 11/2007 Zugibe ..... F25B 49/02 62/216
2007/0277537 A1* 12/2007 Parthasarathy ..... B64D 13/06 62/149
(Continued)

FOREIGN PATENT DOCUMENTS

CN 102667352 9/2012
CN 108763721 11/2018
(Continued)

OTHER PUBLICATIONS

International Search Report for PCT/JP2020/029022 dated Oct. 13, 2020.
(Continued)

*Primary Examiner* — Henry T Crenshaw
(74) *Attorney, Agent, or Firm* — IPUSA, PLLC

(57) ABSTRACT

A refrigerant amount determining device includes: an operation data acquiring unit configured to acquire operation data of an air conditioning system; a calculating unit configured to calculate a refrigerant amount index value from the operation data acquired; an inferring unit configured to infer information regarding correction of the refrigerant amount index value using a correction model and at least one of the acquired operation data or the calculated refrigerant amount index value; and a determining unit configured to determine
(Continued)

a refrigerant amount of the air conditioning system based on the information regarding correction of the refrigerant amount index value.

30 Claims, 23 Drawing Sheets

(52) U.S. Cl.
CPC ... *F25B 2400/13* (2013.01); *F25B 2600/2513* (2013.01); *F25B 2700/04* (2013.01); *F25B 2700/21151* (2013.01); *F25B 2700/21152* (2013.01)

(58) Field of Classification Search
CPC ..... F25B 2700/21152; F25B 2700/04; F24F 11/36; F24F 11/64
See application file for complete search history.

(56) References Cited

U.S. PATENT DOCUMENTS

| | | | | |
|---|---|---|---|---|
| 2011/0112814 | A1 | 5/2011 | Clark | |
| 2011/0174059 | A1* | 7/2011 | Yonemori | F25B 49/005 73/40 |
| 2011/0308267 | A1 | 12/2011 | Tamaki et al. | |
| 2012/0041608 | A1* | 2/2012 | Zugibe | G06F 30/20 700/285 |
| 2015/0004898 | A1* | 1/2015 | Desrochers | F24F 11/30 454/239 |
| 2016/0370026 | A1 | 12/2016 | Denton et al. | |
| 2017/0198953 | A1* | 7/2017 | Connell | F25B 13/00 |
| 2019/0170603 | A1* | 6/2019 | Gupte | F25B 49/005 |
| 2019/0362036 | A1 | 11/2019 | Zhang et al. | |
| 2019/0390885 | A1* | 12/2019 | Contrada | G01N 21/31 |
| 2020/0141621 | A1* | 5/2020 | Brady | G06F 9/542 |
| 2020/0208861 | A1* | 7/2020 | Chen | G06N 3/0454 |

FOREIGN PATENT DOCUMENTS

| | | |
|---|---|---|
| EP | 2333461 | 6/2011 |
| EP | 3348939 | 7/2018 |
| JP | 2009-243829 | 10/2009 |
| JP | 2011-099591 | 5/2011 |
| JP | 2012-255648 | 12/2012 |
| JP | 2017-053566 | 3/2017 |
| JP | 2018-533718 | 11/2018 |
| WO | 2017/087628 | 5/2017 |
| WO | 2018/225419 | 12/2018 |

OTHER PUBLICATIONS

International Preliminary Report on Patentability for PCT/JP2020/029022 dated Mar. 17, 2022.
Partial Supplementary European Search Report for 20862898.2 dated Sep. 15, 2022.
Extended European Search Report for 20862898.2 dated Dec. 13, 2022.

* cited by examiner

APPARATUS, METHOD, AND PROGRAM FOR ESTIMATING AMOUNT OF REFRIGERANT

TECHNICAL FIELD

The present invention relates to an apparatus, a method, and a program for estimating an amount of a refrigerant.

BACKGROUND ART

Conventionally, a method for detecting loss (leakage of refrigerant) of a filled amount of refrigerant of a cooling system based on an index value of a refrigerant amount filled (hereinafter, also referred to as a refrigerant amount index value) is disclosed. Specifically, PTL 1 discloses calculating a real-time air side temperature difference across an evaporator; calculating a first air side temperature difference across the evaporator by applying an algorithm having a first T-Map representative of normal operating conditions; and taking an action if the real-time air side temperature difference is less than the first air side temperature difference (PTL 1, paragraph [0004]).

CITATION LIST

Patent Literature

[PTL 1]
Japanese Translation of PCT International Application Publication No. JP-T-2018-533718

SUMMARY OF INVENTION

Technical Problem

However, in a prediction using a map as described in PTL 1, an argument of the parameter that affects the refrigerant amount index value other than change in a refrigerant amount is a discrete value. Accordingly, the predicted value of the refrigerant amount index value predicted by the map is a discrete value. Therefore, when the step width of the argument is large, the accuracy of the prediction by the map is poor, and when the step width is small in order to increase the accuracy of the prediction, the amount of data of the map is large. Moreover, when the types of parameters for the arguments increase, the map is multidimensional, and the amount of data is large, making implementation difficult. The present disclosure is intended to facilitate the determination of the refrigerant amount.

Solution to Problem

The 1st aspect of the present disclosure is: a refrigerant amount determining device including an operation data acquiring unit configured to acquire operation data of an air conditioning system; a calculating unit configured to calculate a refrigerant amount index value from the operation data acquired; an inferring unit configured to infer information regarding correction of the refrigerant amount index value using a correction model and at least one of the acquired operation data or the calculated refrigerant amount index value; and a determining unit configured to determine a refrigerant amount of the air conditioning system based on the information regarding correction of the refrigerant amount index value.

According to a 1st aspect of the present disclosure, an argument of the parameter that affects the refrigerant amount index value and a predicted value are continuous values, providing easy implementation even when the types of parameters for the arguments increase.

A 2nd aspect of the present disclosure is: the refrigerant amount determining device according to the 1st aspect, wherein the inferring unit is configured to infer a corrected refrigerant amount index value in which the calculated refrigerant amount index value is corrected, using the calculated refrigerant amount index value and the correction model, and the determining unit is configured to determine the refrigerant amount of the air conditioning system based on the corrected refrigerant amount index value.

A 3rd aspect of the present disclosure is: the refrigerant amount determining device according to the 1st aspect, wherein the operation data includes first operation data and second operation data, the first operation data and the second operation data being at least partially different, or the first operation data and the second operation data being at least partially identical, the calculating unit is configured to calculate the refrigerant amount index value from the first operation data, the inferring unit is configured to infer a corrected refrigerant amount index value in which the calculated refrigerant amount index value is corrected using the second operation data, the calculated refrigerant amount index value, and the correction model, and the determining unit is configured to determine the refrigerant amount of the air conditioning system based on the corrected refrigerant amount index value.

A 4th aspect of the present disclosure is: the refrigerant amount determining device according to the 1st aspect, wherein the operation data includes first operation data and second operation data, the first operation data and the second operation data being at least partially different, or the first operation data and the second operation data being at least partially identical, the calculating unit is configured to calculate the refrigerant amount index value from the first operation data, the inferring unit is configured to infer a corrected range of the refrigerant amount index value using the second operation data and the correction model, and the determining unit is configured to determine the refrigerant amount of the air conditioning system based on the calculated refrigerant amount index value and the corrected range of the refrigerant amount index value.

A 5th aspect of the present disclosure is: the refrigerant amount determining device according to the 1st aspect, wherein the operation data includes first operation data and second operation data, the first operation data and the second operation data being at least partially different, or the first operation data and the second operation data being at least partially identical, the calculating unit is configured to calculate the refrigerant amount index value from the first operation data, the inferring unit is configured to infer information for specifying a corrected refrigerant amount index value in which the calculated refrigerant amount index value is corrected using the second operation data and the correction model, and the determining unit is configured to determine the refrigerant amount of the air conditioning system based on the calculated refrigerant amount index value and the information for specifying the corrected refrigerant amount index value.

A 6th aspect of the present disclosure is: the refrigerant amount determining device according to the 1st aspect, wherein the operation data includes first operation data and second operation data, the first operation data and the second operation data being at least partially different, or the first operation data and the second operation data being at least partially identical, the calculating unit is configured to calculate the refrigerant amount index value from the first operation data, the inferring unit is configured to infer a corrected difference or ratio between the calculated refrigerant amount index value and a predicted value of the refrigerant amount index value predicted from the second operation data using the second operation data, the calculated refrigerant amount index value, and the correction model, and the determining unit is configured to determine the refrigerant amount of the air conditioning system based on the corrected difference or ratio.

A 7th aspect of the present disclosure is: the refrigerant amount determining device according to any one of the 2nd to 6th aspects, wherein one or more refrigerant amount index value and one or more correction model is used.

An 8th aspect of the present disclosure is: the refrigerant amount determining device according to any one of the 1st to 7th aspects, wherein the correction model is a model learned by associating the operation data at at least one of normal operation and abnormal operation and the refrigerant amount index value with each other.

A 9th aspect of the present disclosure is: the refrigerant amount determining device according to the 8th aspect, wherein the operation data at at least one of normal operation and abnormal operation includes at least one of measured data and pseudo data.

A 10th aspect of the present disclosure is: the refrigerant amount determining device according to any one of the 1st to 9th aspects, further including an output correction unit that is configured to correct the information regarding correction of the refrigerant amount index value.

An 11th aspect of the present disclosure is: the refrigerant amount determining device according to the 10th aspect, wherein the output correction unit is configured to correct an offset amount between: the refrigerant amount index value when the refrigerant amount is a designed value; and the measured value of the refrigerant amount index value.

A 12th aspect of the present disclosure is: the refrigerant amount determining device according to any one of the 1st to 9th aspects, further including an input correction unit that is configured to correct the operation data.

A 13th aspect of the present disclosure is: the refrigerant amount determining device according to the 12th aspect, wherein the input correction unit is configured to increase or decrease an acquisition interval of the operation data according to a number of pieces of the operation data.

A 14th aspect of the present disclosure is: the refrigerant amount determining device according to the 12th aspect, wherein the operation data includes at least one of measured data or pseudo data, and the input correction unit is configured to create pseudo data of the operation data.

A 15th aspect of the present disclosure is: the refrigerant amount determining device according to any one of the 1st to 9th aspects, further including: an output correction unit that is configured to correct the information regarding correction of the refrigerant amount index value; and an input correction unit that is configured to correct the operation data.

A 16th aspect of the present disclosure is: the refrigerant amount determining device according to any one of the 1st to 15th aspects, further including an outputting unit that is configured to output a determination result of at least one of a value for determining the refrigerant amount, a category for determining the refrigerant amount, or both a category for determining the refrigerant amount and a reliability thereof.

A 17th aspect of the present disclosure is: the refrigerant amount determining device according to the 16th aspect, wherein the determining unit is configured to perform the determination using a determination result output by the outputting unit.

An 18th aspect of the present disclosure is: the refrigerant amount determining device according to the 16th aspect, further including a learned model acquiring unit that is configured to acquire a correction model that is a result of learning in which the operation data and the refrigerant amount index value are associated with each other.

A 19th aspect of the present disclosure is: the refrigerant amount determining device according to the 18th aspect, wherein the learned model acquiring unit is configured to acquire an optimum correction model using the determination result output by the outputting unit.

A 20th aspect of the present disclosure is: the refrigerant amount determining device according to the 16th aspect, further including a learning unit that is configured to learn by associating the operation data and the refrigerant amount index value with each other.

A 21st aspect of the present disclosure is: the refrigerant amount determining device according to the 20th aspect, wherein the learning unit is configured to relearn using the determination result output by the outputting unit.

A 22nd aspect of the present disclosure is: the refrigerant amount determining device according to the 20th aspect, wherein the learning unit is configured to change the learning data using the determination result output by the outputting unit and relearn the correction model.

A 23rd aspect of the present disclosure is: the refrigerant amount determining device according to any one of the 1st to 22nd aspects, wherein the correction model is a model learned by associating external sensor data, the operation data, and a refrigerant amount index with one another, the operation data acquiring unit is configured to further acquire external sensor data, and the inferring unit is configured to infer the information regarding correction of the refrigerant amount index value using the acquired external sensor data, the operation data, and the correction model.

A 24th aspect of the present disclosure is: the refrigerant amount determining device according to any one of the 1st to 22nd aspects, wherein the correction model is a model learned by associating image data, the operation data, and a refrigerant amount index with one another, the operation data acquiring unit is configured to further acquire image data, and the inferring unit is configured to infer the information regarding correction of the refrigerant amount index value using the acquired image data, the operation data, and the correction model.

A 25th aspect of the present disclosure is: the refrigerant amount determining device according to any one of the 1st to 22nd aspects, wherein the correction model is a model learned by associating installation status data of the air conditioning system, the operation data, and a refrigerant amount index with one another, the operation data acquiring unit is configured to further acquire installation status data, and the inferring unit is configured to infer the information regarding correction of the refrigerant amount index value using the acquired installation status data, the operation data, and the correction model.

A 26th aspect of the present disclosure is: the refrigerant amount determining device according to any one of the 1st to 25th aspects, wherein the operation data includes at least one of outdoor temperature, a rotation speed of a compressor, an opening degree of an expansion valve of a subcooling heat exchanger, and a current value of the compressor.

A 27th aspect of the present disclosure is: the refrigerant amount determining device according to any one of the 1st to 26th aspects, wherein the refrigerant amount index value includes at least one of a degree of subcooling at an outdoor heat exchanger outlet; a degree of superheating in suction of a compressor; a degree of superheating in discharge of the compressor; and a value based on the degree of subcooling at the outdoor heat exchanger outlet, the degree of superheating in suction of the compressor, or the degree of superheating in discharge of the compressor.

A 28th aspect of the present disclosure is: the refrigerant amount determining device according to any one of the 1st to 27th aspects, wherein the refrigerant amount index value includes at least one of a degree of subcooling at a subcooling heat exchanger outlet and a value based on the degree of subcooling at the subcooling heat exchanger outlet.

A 29th aspect of the present disclosure is: the refrigerant amount determining device according to any one of the 1st to 26th aspects, wherein the refrigerant amount index value includes at least one of a degree of subcooling at an indoor heat exchanger outlet and a value based on the degree of subcooling at the indoor heat exchanger outlet, the degree of subcooling at the indoor heat exchanger outlet is any one of at least one of the degree of subcooling of indoor heat exchangers; an average value of the indoor heat exchangers; or a degree of subcooling at an indoor or outdoor confluence of the indoor heat exchangers.

A 30th aspect of the present disclosure is: the refrigerant amount determining device according to the 27th or 28th aspect, wherein the refrigerant amount index value is a combination of a degree of subcooling at an indoor heat exchanger outlet of a simultaneous cooling and heating operation device in a heating operation mode and a degree of subcooling at an outdoor heat exchanger outlet, functioning as condenser, of the simultaneous cooling and heating operation device.

A 31st aspect of the present disclosure is: the refrigerant amount determining device according to any one of the 1st to 30th aspects, wherein the operation data includes at least one of:

opening degree of an indoor unit expansion valve
opening degree of an outdoor unit main expansion valve
total value of rated power of an indoor unit during operation or standby
number of indoor units in operation
power of the indoor unit (cooling or heating)
blowout temperature of the indoor unit
room temperature
condensation temperature
evaporation temperature
refrigerant temperature of an outdoor unit liquid shutoff valve connection pipe
refrigerant temperature of a liquid connection pipe
flow rate of an outdoor unit fan
flow rate of an indoor unit fan
rotation speed of the outdoor unit fan (step, tap)
rotation speed of the indoor unit fan (step, tap)
current value of the outdoor unit fan
current value of the indoor unit fan
circulation volume of a refrigerant
discharge temperature of a compressor
suction temperature of the compressor
degree of superheating in discharge of the compressor
degree of superheating in suction of the compressor
degree of subcooling at a subcooling heat exchanger outlet
degree of superheating at the subcooling heat exchanger outlet (a gas pipe side)
degree of subcooling at an economizer outlet
opening degree of an expansion valve for an economizer
outlet pressure of the economizer bypass side
opening degree of the expansion valve for intermediate injection
intermediate injection temperature
intermediate injection pressure
water temperature of an evaporator inlet
water temperature of an evaporator outlet
water temperature of a condenser inlet, or
water temperature of a condenser outlet.

A 32nd aspect of the present disclosure is: the refrigerant amount determining device according to the 29th or 30th aspect, wherein the operation data includes at least one of a number of times of defrosting, or duration of defrosting.

A 33rd aspect of the present disclosure is: the refrigerant amount determining device according to any one of the 1st to 32nd aspects, wherein the determining unit is configured to determine the refrigerant amount of the air conditioning system based on both a difference or ratio between: the calculated refrigerant amount index value; and an inferred predicted value of the refrigerant amount index value at a normal operation, and a difference or ratio between: the refrigerant amount index value calculated from an operating condition when the operation data for calculating the refrigerant amount index value was acquired and from a past operation data that was acquired when an operating condition was in a predetermined range; and an inferred predicted value of the refrigerant amount index value at a normal operation.

A 34th aspect of the present disclosure is: the refrigerant amount determining device according to the 33rd aspect, wherein the operating condition is an outdoor temperature.

A 35th aspect of the present disclosure is: the refrigerant amount determining device according to any one of the 1st to 34th aspects, wherein the determining unit is configured to determine a ratio of a leakage amount to an appropriate amount of the refrigerant of the air conditioning system based on a difference or ratio between the calculated refrigerant amount index value and an inferred predicted value of the refrigerant amount index value at a normal operation.

A 36th aspect of the present disclosure is:

a method including:

acquiring operation data of an air conditioning system;

calculating a refrigerant amount index value from the operation data acquired;

correcting the refrigerant amount index value using the acquired operation data and a correction model; and determining a refrigerant amount of the air conditioning system based on the corrected refrigerant amount index value.

A 37th aspect of the present disclosure is:

a program for causing a refrigerant amount determining device to function as:

an operation data acquiring unit configured to acquire operation data of an air conditioning system;

a calculating unit configured to calculate a refrigerant amount index value from the operation data acquired;

an inferring unit configured to correct the refrigerant amount index value using the acquired operation data and a correction model; and a determining unit configured to determine a refrigerant amount of the air conditioning system based on the corrected refrigerant amount index value.

DESCRIPTION OF EMBODIMENTS

Hereinafter, an embodiment of the present disclosure will be described with reference to the drawings.

Figure 1:
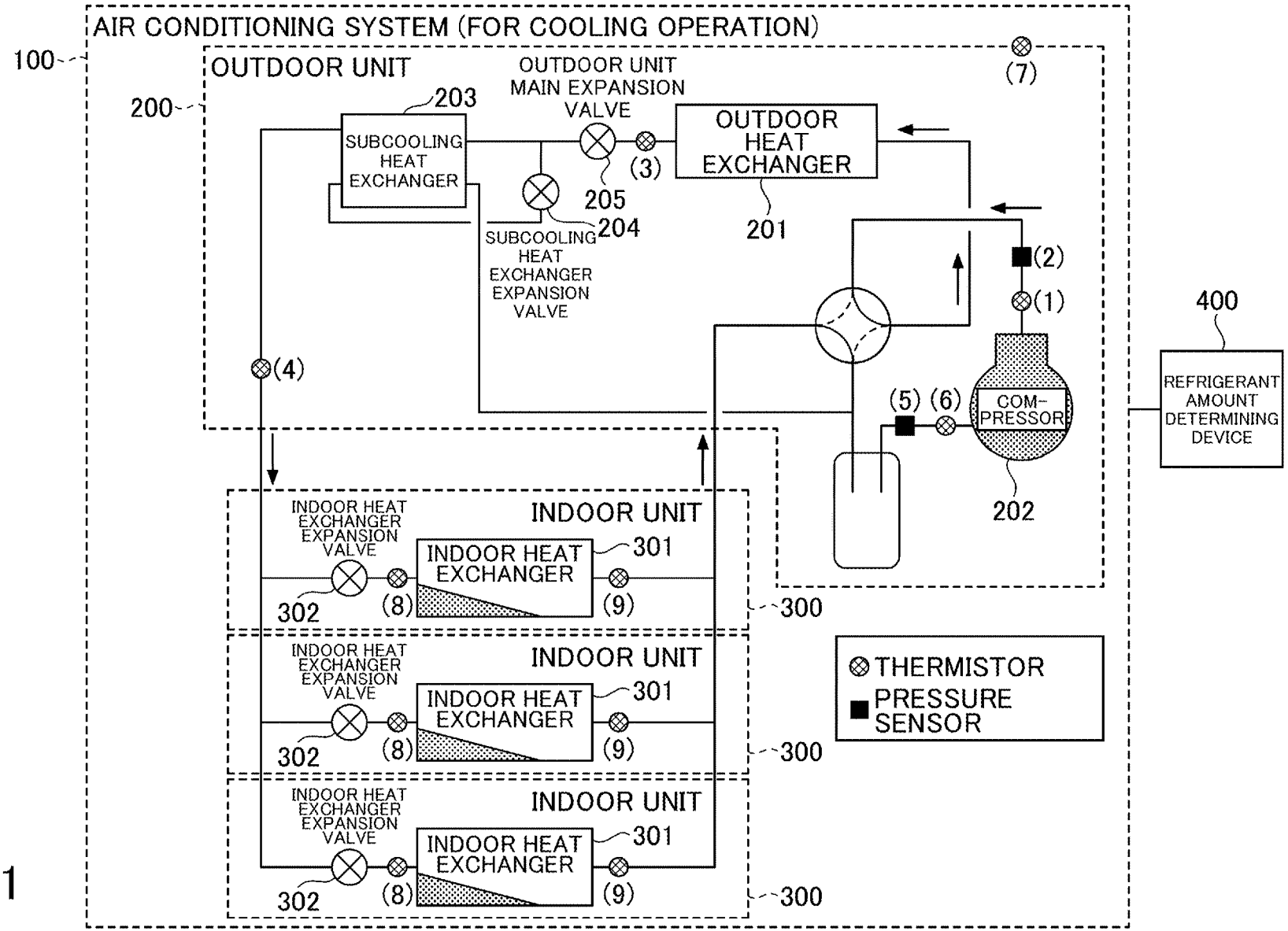
FIG. 1 is a diagram illustrating an overall configuration (for cooling operation) according to an embodiment of the present disclosure.
Figure 2:
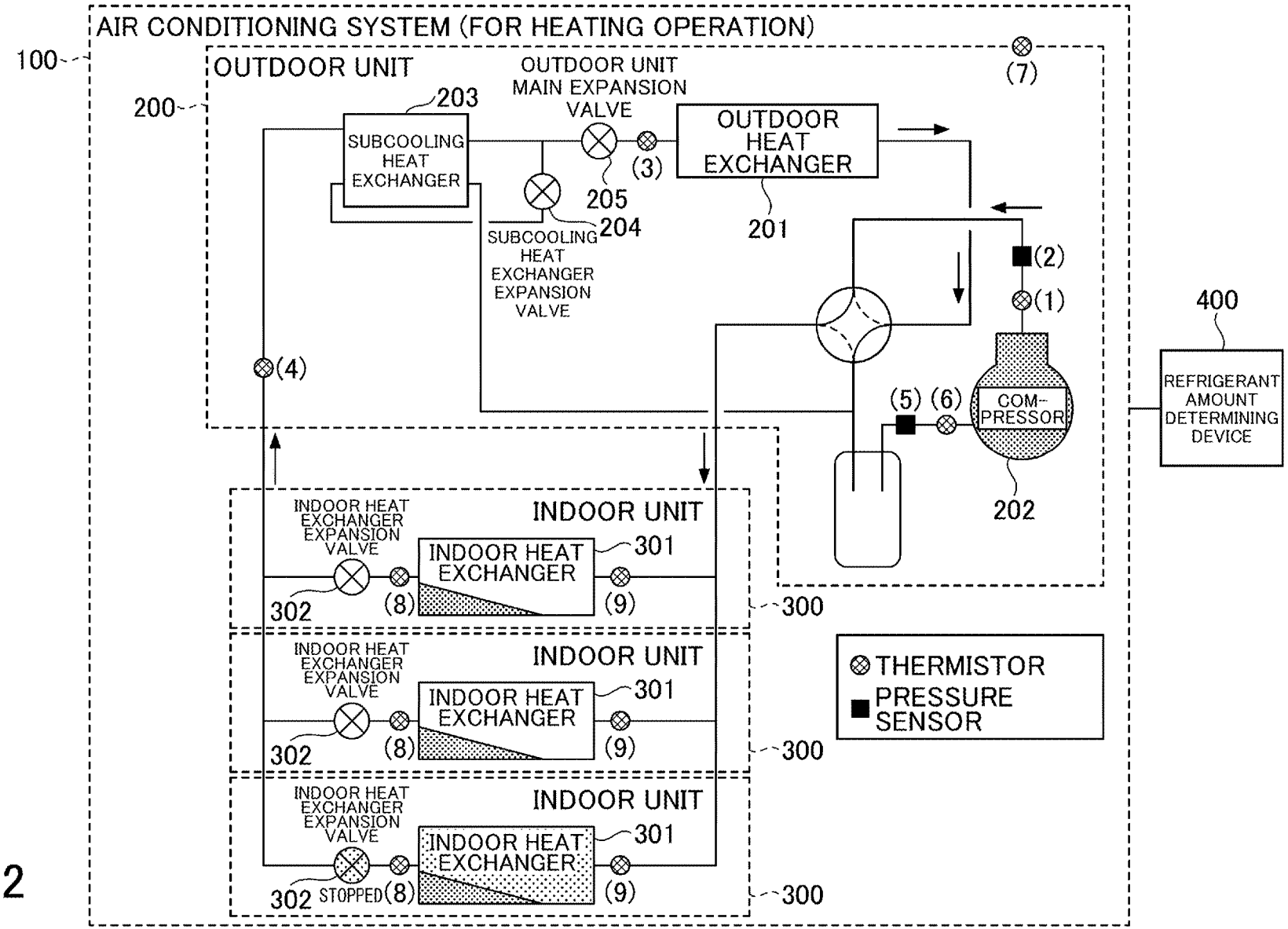
FIG. 2 is a diagram illustrating an overall configuration (for heating operation) according to an embodiment of the present disclosure.
Figure 3:
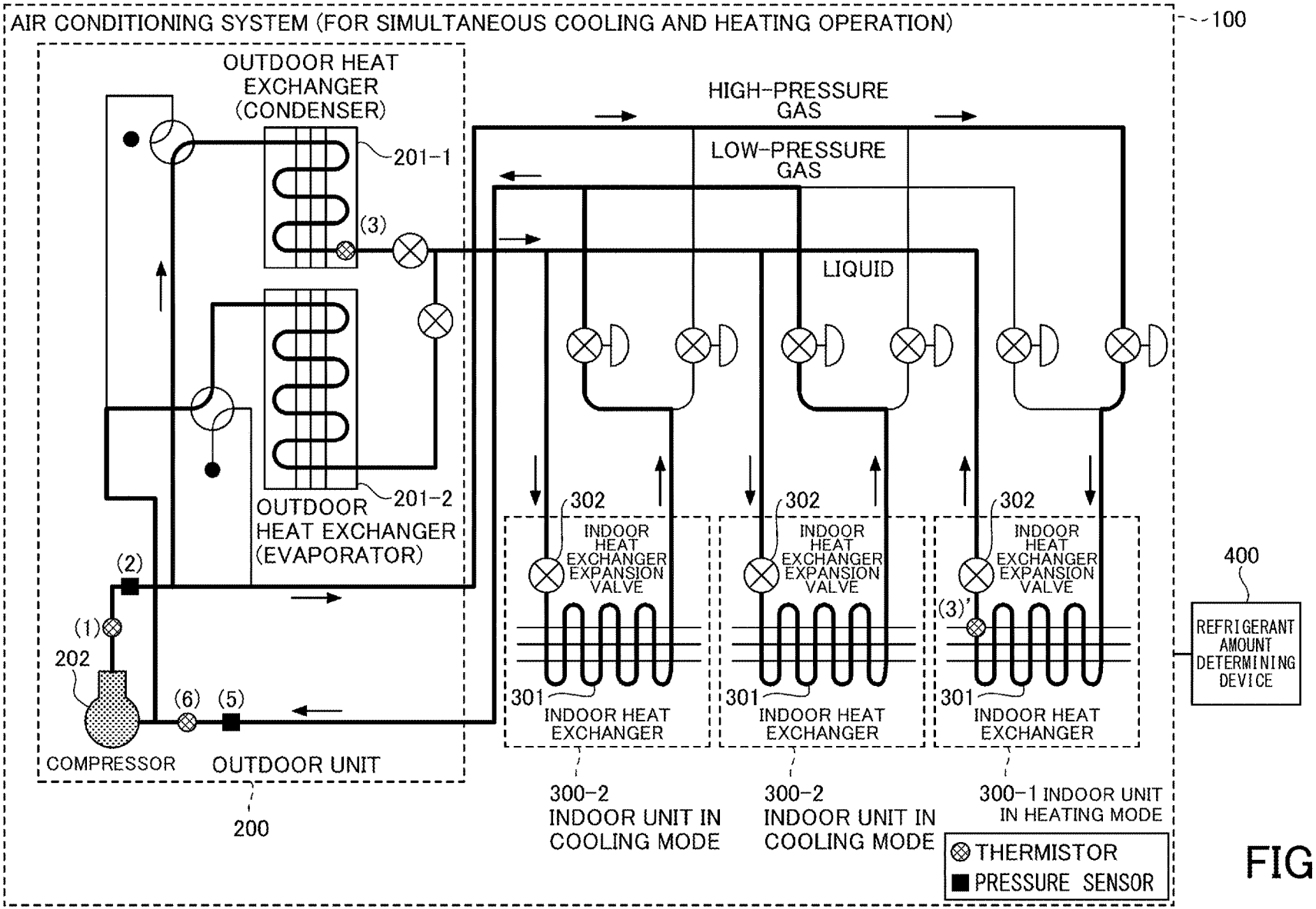
FIG. 3 is a diagram illustrating an overall configuration (for simultaneous cooling and heating operation) according to an embodiment of the present disclosure.

Referring to FIGS. 1 to 3, an overall configuration including an air conditioning system 100 and a refrigerant amount determining device 400 will be described. The air conditioning system 100 may be any air conditioning system such as a multi-air conditioner such as a multi-air conditioner for a building, a central air conditioning system using a chiller as a heat source, an air conditioner for a store or an office, and an air conditioner for a room. In addition to the application for cooling and heating, the air conditioning system 100 may be a refrigerating and freezing system. The air conditioning system 100 may include a plurality of indoor units 300. The indoor units 300 may include indoor units with different performance and indoor units with the same performance. The indoor units 300 may include an indoor unit being stopped.

<Overall Configuration (For Cooling Operation)>

FIG. 1 is a diagram illustrating the overall configuration (for cooling operation) according to an embodiment of the present disclosure. The air conditioning system 100 includes an outdoor unit 200 and one or more indoor units 300.

In the example of FIG. 1, an outdoor heat exchanger 201, an outdoor unit main expansion valve 205, a subcooling heat exchanger 203, an indoor heat exchanger expansion valve 302, an indoor heat exchanger 301, and a compressor 202 are connected by a refrigerant pipe to form a main refrigerant circuit. In the example of FIG. 1, a subcooling heat exchanger expansion valve 204 is further provided in a bypass pipe connected from the pipe between the outdoor heat exchanger 201 and the subcooling heat exchanger 203 to the pipe on the intake side of the compressor 202. The subcooling heat exchanger 203 is a heat exchanger that exchanges heat between the refrigerant that passes through the subcooling heat exchanger expansion valve 204, which is provided on the bypass pipe connected from the pipe between the outdoor heat exchanger 201 and the subcooling heat exchanger 203 to the pipe on the intake side of the compressor 202, and the refrigerant in the main refrigerant circuit. The bypass example of FIG. 1 is an example.

«Outdoor Unit»

On the outdoor unit 200 side, the outdoor heat exchanger 201, the compressor 202, the subcooling heat exchanger 203, the subcooling heat exchanger expansion valve (bypass circuit) 204, and the outdoor unit main expansion valve (main refrigerant circuit) 205 are connected to the pipe. The outdoor unit 200 includes a variety of sensors (for example, temperature sensors (for example, thermistors) (1), (3), (4), (6), and (7), and pressure sensors (2) and (5), and the like).

«Indoor Unit»

On the indoor unit 300 side, the indoor heat exchanger 301 and the indoor heat exchanger expansion valve 302 are connected to the pipe. The indoor unit 300 includes a variety of sensors (for example, temperature sensors (for example, thermistors) (8) and (9), and the like).

«Refrigerant Amount Determining Device»

The refrigerant amount determining device 400 is a device for determining the refrigerant amount of the air conditioning system 100. The refrigerant amount determining device 400 will be described in detail below with reference to FIGS. 4 to 5.

The refrigerant amount determining device 400 may be implemented on a device (for example, a computer installed in the same building or the like as the air conditioning system 100, or a cloud server remote from the air conditioning system 100) communicatively connected with the air conditioning system 100. The refrigerant amount determining device 400 may be implemented as part of the air conditioning system 100 (for example, installed in the outdoor unit 200 or in the indoor unit 300).

<Overall Configuration (For Heating Operation)>

FIG. 2 is a diagram illustrating an overall configuration (for heating operation) according to an embodiment of the present disclosure. The air conditioning system 100 includes an outdoor unit 200 and one or more indoor units 300.

In the example of FIG. 2, the outdoor heat exchanger 201, the compressor 202, the indoor heat exchanger 301, the indoor heat exchanger expansion valve 302, the subcooling heat exchanger 203, and the outdoor unit main expansion valve 205 are connected by a refrigerant pipe to form a main refrigerant circuit. In the example of FIG. 2, the subcooling heat exchanger expansion valve 204 is further provided in a bypass pipe connected from the pipe between the outdoor heat exchanger 201 and the subcooling heat exchanger 203 to the pipe on the intake side of the compressor 202. The subcooling heat exchanger 203 is a heat exchanger that exchanges heat between the refrigerant that passes through the subcooling heat exchanger expansion valve 204, which is provided on the bypass pipe connected from the pipe between the outdoor heat exchanger 201 and the subcooling heat exchanger 203 to the pipe on the intake side of the compressor 202, and the refrigerant in the main refrigerant circuit. The bypass example of FIG. 2 is an example.

«Outdoor Unit»

On the outdoor unit 200 side, the outdoor heat exchanger 201, the compressor 202, the subcooling heat exchanger 203, the subcooling heat exchanger expansion valve (bypass circuit) 204, and the outdoor unit main expansion valve (main refrigerant circuit) 205 are connected to the pipe. The outdoor unit 200 includes a variety of sensors (for example, temperature sensors (for example, thermistors) (1), (3), (4), (6), and (7), and pressure sensors (2) and (5), and the like).

«Indoor Unit»

On the indoor unit 300 side, the indoor heat exchanger 301 and the indoor heat exchanger expansion valve 302 are connected to the pipe. The indoor unit 300 includes a variety of sensors (for example, temperature sensors (for example, thermistors) (8) and (9), and the like).

«Refrigerant Amount Determining Device»

The refrigerant amount determining device 400 is a device for determining the refrigerant amount of the air conditioning system 100. The refrigerant amount determining device 400 will be described in detail below with reference to FIGS. 4 to 5.

The refrigerant amount determining device 400 may be implemented on a device (for example, a computer installed in the same building or the like as the air conditioning system 100, or a cloud server remote from the air conditioning system 100) communicatively connected with the air conditioning system 100. The refrigerant amount determining device 400 may be implemented as part of the air conditioning system 100 (for example, installed in the outdoor unit 200 or in the indoor unit 300).

<Overall Configuration (For Simultaneous Cooling and Heating Operation)>

The present disclosure may be applicable not only to cooling operation and heating operation, but also to simultaneous cooling and heating operation. Hereinafter, the simultaneous cooling and heating operation will be described with reference to FIG. 3.

FIG. 3 is a diagram illustrating an overall configuration (for simultaneous cooling and heating operation) according to an embodiment of the present disclosure. The air conditioning system 100 has a configuration in which a two-part structure having an outdoor heat exchanger 201-1 and an outdoor heat exchanger 201-2 and a plurality of indoor units are connected with three connection pipe. The air conditioning system 100 is capable of simultaneous cooling and heating operation. FIG. 3 illustrates an example in which the cooling operation is the main operation, and an indoor unit 300-1 is in a heating mode and indoor units 300-2 are in a cooling mode. In the operation, the outdoor heat exchanger 201-1 functions as a condenser, and the outdoor heat exchanger 201-2 functions as an evaporator.

«Refrigerant Amount Determining Device»

The refrigerant amount determining device 400 is a device for determining the refrigerant amount of the air conditioning system 100. The refrigerant amount determining device 400 will be described in detail below with reference to FIGS. 4 to 5.

The refrigerant amount determining device 400 may be implemented on a device (for example, a computer installed in the same building or the like as the air conditioning system 100, or a cloud server remote from the air conditioning system 100) communicatively connected with the air conditioning system 100. The refrigerant amount determining device 400 may be implemented as part of the air conditioning system 100 (for example, installed in the outdoor unit 200 or in the indoor unit 300).

<Hardware Configuration of Refrigerant Amount Determining Device>

Figure 4:
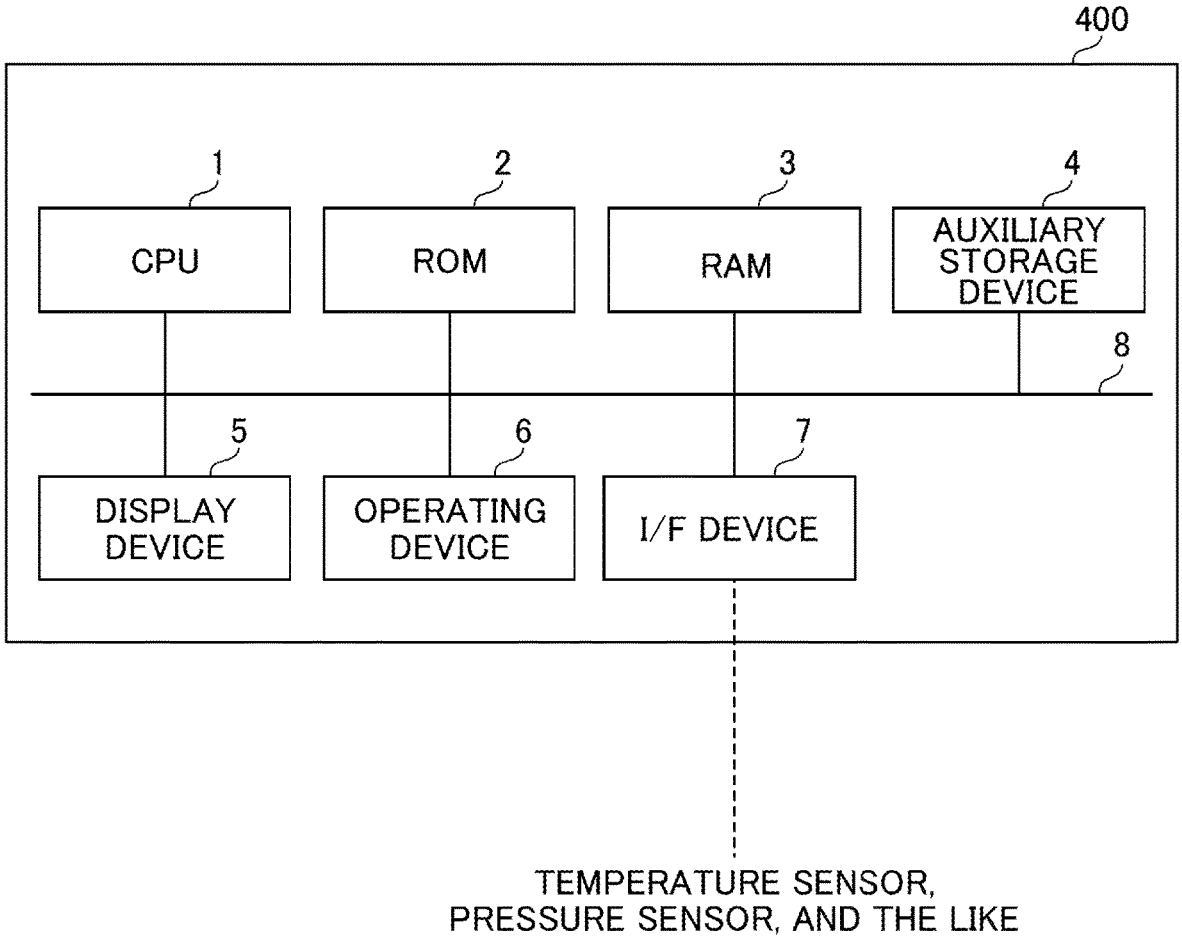
FIG. 4 is a diagram illustrating a hardware configuration of a refrigerant amount determining device according to an embodiment of the present disclosure.

FIG. 4 is a hardware configuration diagram of a refrigerant amount determining device 400 according to an embodiment of the present disclosure. The refrigerant amount determining device 400 includes a Central Processing Unit (CPU) 1, Read Only Memory (ROM) 2, and Random Access Memory (RAM) 3. The CPU 1, ROM 2, and RAM 3 form what is known as a computer.

The refrigerant amount determining device 400 may include an auxiliary storage device 4, a display device 5, an operating device 6, and an interface (I/F) device 7. Each of the hardware of the refrigerant amount determining device 400 is connected to each other via a bus 8.

The CPU 1 is an arithmetic device which executes various programs installed in the auxiliary storage device 4.

The ROM 2 is a non-volatile memory. The ROM 2 functions as a main storage device for storing various programs, data, and the like necessary for the CPU 1 to execute various programs installed in the auxiliary storage device 4. Specifically, The ROM 2 functions as a main storage device for storing a boot program such as Basic Input/Output System (BIOS) and Extensible Firmware Interface (EFI), and the like.

The RAM 3 is a volatile memory such as Dynamic Random Access Memory (DRAM) and Static Random Access Memory (SRAM). The RAM 3 functions as a main storage device that provides a workspace deployed when various programs installed in the auxiliary storage device 4 are executed by the CPU 1.

The auxiliary storage device 4 is an auxiliary storage device that stores various programs and information used when the various programs are executed.

The display device 5 is a display device that displays the internal state and the like of the refrigerant amount determining device 400.

The operating device 6 is an input device in which an administrator of the refrigerant amount determining device 400 inputs various instructions to the refrigerant amount determining device 400.

The I/F device 7 is a communication device that connects to various sensors and networks and communicates with other terminals.

<Function Block of Refrigerant Amount Determining Device>

Figure 5:
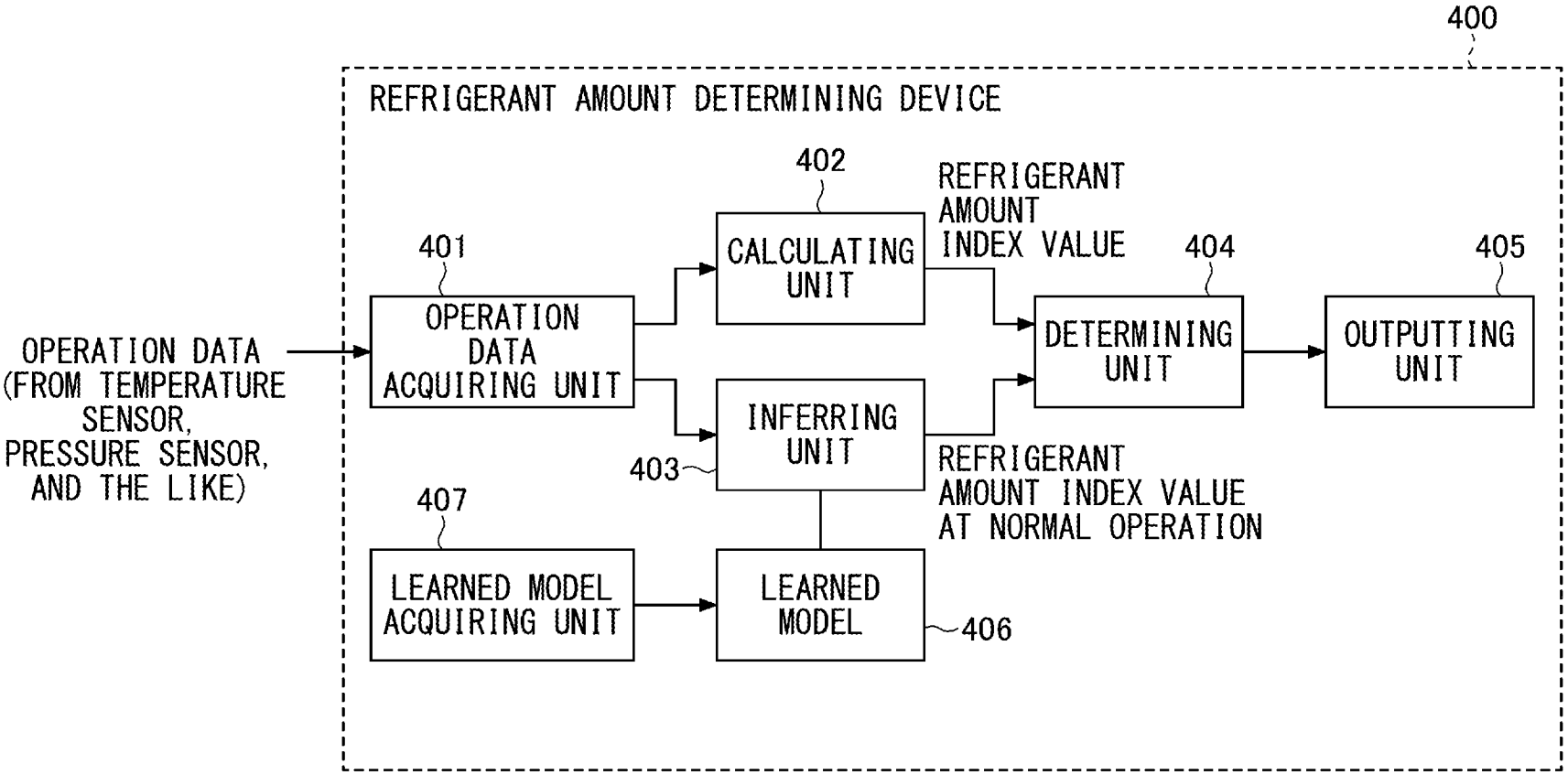
FIG. 5 is a functional block diagram of the refrigerant amount determining device according to an embodiment of the present disclosure.

FIG. 5 is a functional block diagram of the refrigerant amount determining device 400 according to an embodiment of the present disclosure. The refrigerant amount determining device 400 may include an operation data acquiring unit 401, a calculating unit 402, an inferring unit 403, a determining unit 404, an outputting unit 405, a learned model 406, and a learned model acquiring unit 407. The refrigerant amount determining device 400 may function as the operation data acquiring unit 401, the calculating unit 402, the inferring unit 403, the determining unit 404, the outputting unit 405, and the learned model acquiring unit 407, by executing a program.

The operation data acquiring unit 401 acquires operation data (that is, current operation data) of the air conditioning system 100 from various sensors (temperature sensors, pressure sensors, and the like) of the air conditioning system 100. The operation data of the air conditioning system 100 is data that may be acquired during operation of the air conditioning system 100.

The calculating unit 402 calculates the refrigerant amount index value from the operation data acquired by the operation data acquiring unit 401. The refrigerant amount index value is an indicative value of the refrigerant amount and correlates with the refrigerant amount (details will be described later).

The inferring unit 403 infers a predicted value of the refrigerant amount index value at the normal operation from the operation data (correlating with the refrigerant amount index value; details will be described later) acquired by the operation data acquiring unit 401 based on the result of learning (the learned model 406) in which the operation data at the normal operation and the refrigerant amount index value are associated with each other. Specifically, the inferring unit 403 inputs the operation data acquired by the operation data acquiring unit 401 to the learned model 406 to obtain an output of a predicted value of the refrigerant amount index value at the normal operation.

The determining unit 404 determines the refrigerant amount of the air conditioning system 100 based on the difference or ratio between the refrigerant amount index value calculated by the calculating unit 402 and the predicted value of the refrigerant amount index value at the normal operation inferred by the inferring unit 403 (details will be described later).

The outputting unit 405 outputs the result determined by the determining unit 404. For example, the outputting unit 405 informs the administrator of the air conditioning system 100 of a leak of refrigerant.

The learned model 406 is the result of learning in which the operation data at the normal operation and the refrigerant amount index value are associated with each other, as described above.

The learned model acquiring unit 407 acquires the learned model 406 from the learning device 500.

Hereinafter, specific examples of «Refrigerant amount index value» and «Operation data for inferring predicted value of refrigerant amount index value at normal operation> will be described.

«Refrigerant Amount Index Value (Example 1: For Cooling Operation)»

For example, the refrigerant amount index value may include at least one of the values described below.

Condensation temperature—Outlet temperature of the outdoor heat exchanger 201 (Hereinafter, it is also referred to as degree of subcooling at outdoor heat exchanger outlet. The degree of subcooling may be also referred to as SC or subcool.)

Degree of superheating in suction of the compressor (The degree of superheating may be also referred to as SH or superheat.)

Degree of superheating in discharge of the compressor

Value based on degree of subcooling at outdoor heat exchanger outlet, degree of superheating in suction of the compressor, or degree of superheating in discharge of the compressor For example, the value based on the degree of subcooling at the outdoor heat exchanger outlet is a calculated value using the degree of subcooling at the outdoor heat exchanger outlet. For example, the calculated value using the degree of subcooling at the outdoor heat exchanger outlet is as described below.

Calculated value using degree of subcooling at outdoor heat exchanger outlet=Degree of subcooling at outdoor heat exchanger outlet/(Condensation temperature−outdoor temperature)

For example, the value based on the degree of subcooling at the outdoor heat exchanger outlet is a value defined from a diagram of physical properties of refrigerant and refrigeration cycle (T-S and P-h diagram). Hereinafter, the value defined from the diagram of physical properties of refrigerant and refrigeration cycle (T-S and P-h diagram) will be described with reference to FIG. 8.

Figure 8:
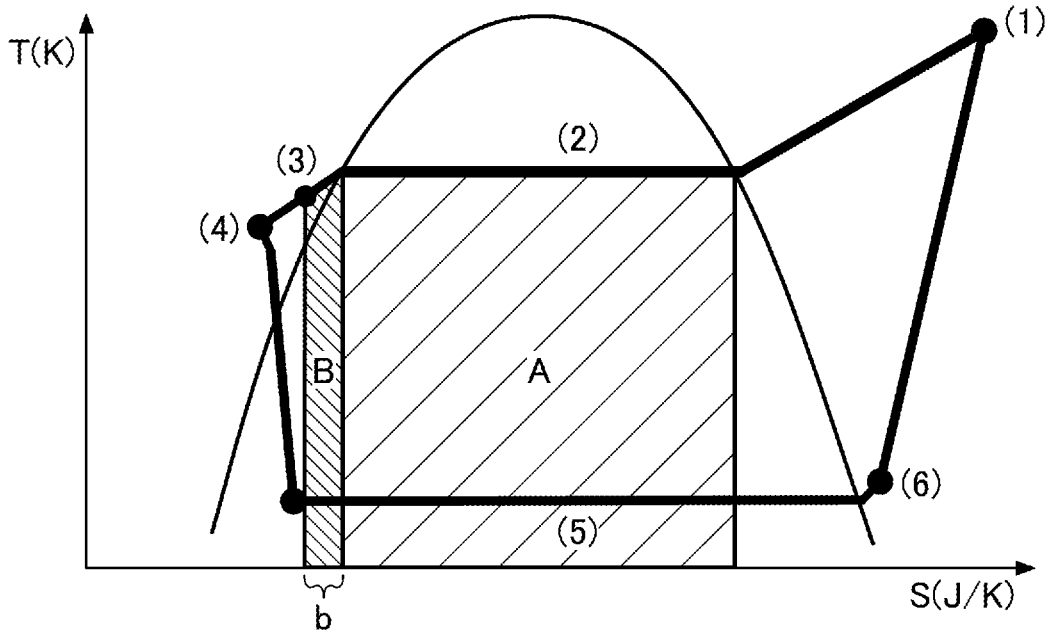
FIG. 8 is a diagram for explaining a refrigerant amount index value according to an embodiment of the present disclosure.

FIG. 8 illustrates a T-S diagram of the refrigerant cycle. For example, the value defined from the diagram of physical properties of refrigerant and refrigeration cycle (T-S and P-h diagram) is as follows.

Value defined from diagram of physical properties of refrigerant and refrigeration cycle (T-S and P-h diagram) (Example 1)=Ratio of area A and area B to one of the other (for example, area B/area A)

Value defined from diagram of physical properties of refrigerant and refrigeration cycle (T-S and P-h diagram) (Example 2)=Line b(=Δh)

Area A is the amount of change in one of exergy, enthalpy, and entropy in the process of the refrigerant being in the gas-liquid two-phase state in the condenser (201, 301) (in other words, the amount of change in one of exergy, enthalpy, and entropy in the process of the refrigerant changing from a saturated gas state to a saturated liquid state in the condenser (201, 301)).

Area B is the amount of change in one of exergy, enthalpy, and entropy in the process of the refrigerant being in the liquid monophase state in the condenser (201, 301) (in other words, the amount of change in one of exergy, enthalpy, and entropy in the process of the refrigerant being cooled from the saturated liquid state and reaching the condenser (201, 301) outlet).

«Refrigerant Amount Index Value (Example 2: For Cooling Operation)»

For example, the refrigerant amount index value may include at least one of the values described below, in addition to the refrigerant amount index value (Example 1) described above or in place of the degree of subcooling at the outdoor heat exchanger outlet of the refrigerant amount index value (Example 1) described above.

Degree of subcooling at a subcooling heat exchanger outlet

Value based on degree of subcooling at the subcooling heat exchanger outlet

«Refrigerant Amount Index Value (Example 3: For Heating Operation)»

In the case of heating operation, the refrigerant amount index value may include, in place of the refrigerant amount index value (Example 1 and Example 2) described above, at least one of degree of subcooling at the indoor heat exchanger outlet and a value based on the degree of subcooling at the indoor heat exchanger outlet. The degree of subcooling at the indoor heat exchanger outlet may be any one of the following: at least one of the degree of subcooling of the indoor heat exchangers 301; an average value of the indoor heat exchangers 301; or the degree of subcooling at the indoor or outdoor confluence of the indoor heat exchangers 301.

«Refrigerant Amount Index Value (Example 3: For Simultaneous Cooling and Heating Operation)»

In the case of simultaneous cooling and heating operation, the refrigerant amount index value may include the value described below, in addition to the refrigerant amount index value (at least one of Example 1 or Example 2) described above.

A combination of degree of subcooling at indoor heat exchanger (the indoor heat exchanger 301 of indoor unit 300-1 for heating in FIG. 3) outlet and degree of subcooling at outdoor heat exchanger (the outdoor heat exchanger (condenser) 201-1 in FIG. 3) outlet.

«Operation Data for Inferring Predicted Value of Refrigerant Amount Index Value at Normal Operation (Example 1)»

For example, the operation data for inferring the predicted value of the refrigerant amount index value at the normal operation may include at least one of the values described below.

Outdoor temperature

Rotation speed of the compressor 202

Opening degree of the expansion valve 204 of subcooling heat exchanger

Current value of the compressor 202

«Operation Data for Inferring Predicted Value of Refrigerant Amount Index Value at Normal Operation (Example 2)»

For example, the operation data for inferring the predicted value of the refrigerant amount index value at the normal operation may include at least one of the values described below, in addition to the operation data (Example 1) described above or in place of the operation data (Example 1) described above.

Opening degree of an indoor unit expansion valve 302

Opening degree of the outdoor unit main expansion valve 205

Total value of rated power of indoor unit during operation or standby

Number of indoor units in operation

Power of indoor unit (cooling or heating)

Blowout temperature of indoor unit

Room temperature

Condensation temperature

Evaporation temperature

Refrigerant temperature of outdoor unit liquid shutoff valve connection pipe (liquid temperature of the connection pipe detected by the thermistor (4) in FIGS. 1 and 2)

Refrigerant temperature of a liquid connection pipe (measured temperature in the communication pipe outside of the outdoor unit 200 detected by an external sensor mounted outside the outdoor unit 200)

flow rate of an outdoor unit fan flow rate of an indoor unit fan

Rotation speed of the outdoor unit fan (Step, Tap)

Rotation speed of the indoor unit fan (Step, Tap)

Current value of outdoor unit fan

Current value of the indoor unit fan

Circulation volume of a refrigerant

Discharge temperature of the compressor 202

Suction temperature of the compressor 202

Degree of superheating in discharge of compressor 202

Degree of superheating in suction of the compressor 202

Figure 13:
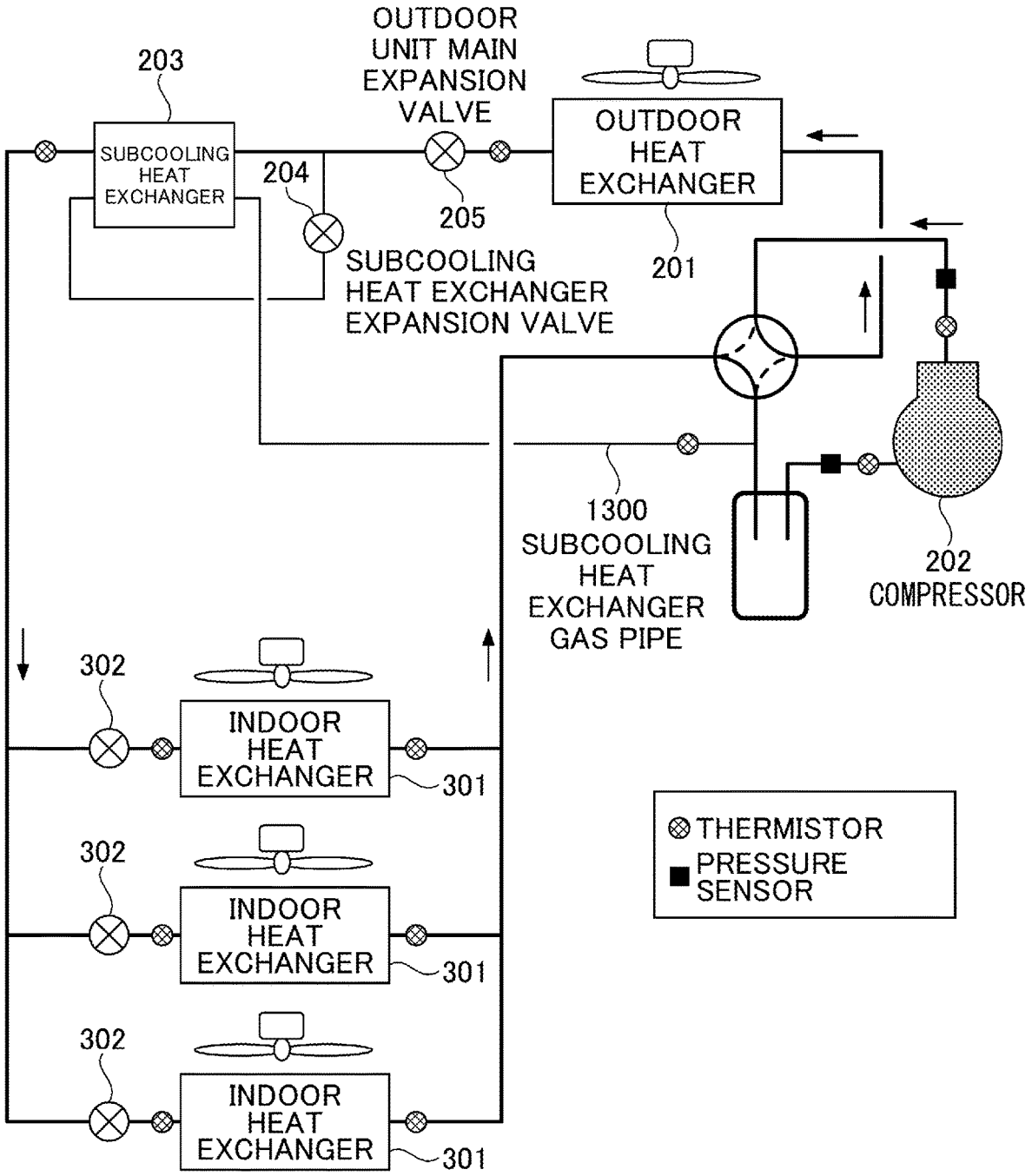
FIG. 13 is an example in which a subcooling heat exchanger circuit is provided according to an embodiment of the present disclosure.

Degree of subcooling at the subcooling heat exchanger 203 outlet (when subcooling heat exchanger circuit is provided (for example, FIG. 13))

Degree of superheating at the subcooling heat exchanger 203 outlet (a gas pipe 1300 side) (when subcooling heat exchanger circuit is provided (for example, FIG. 13))

Figure 14:
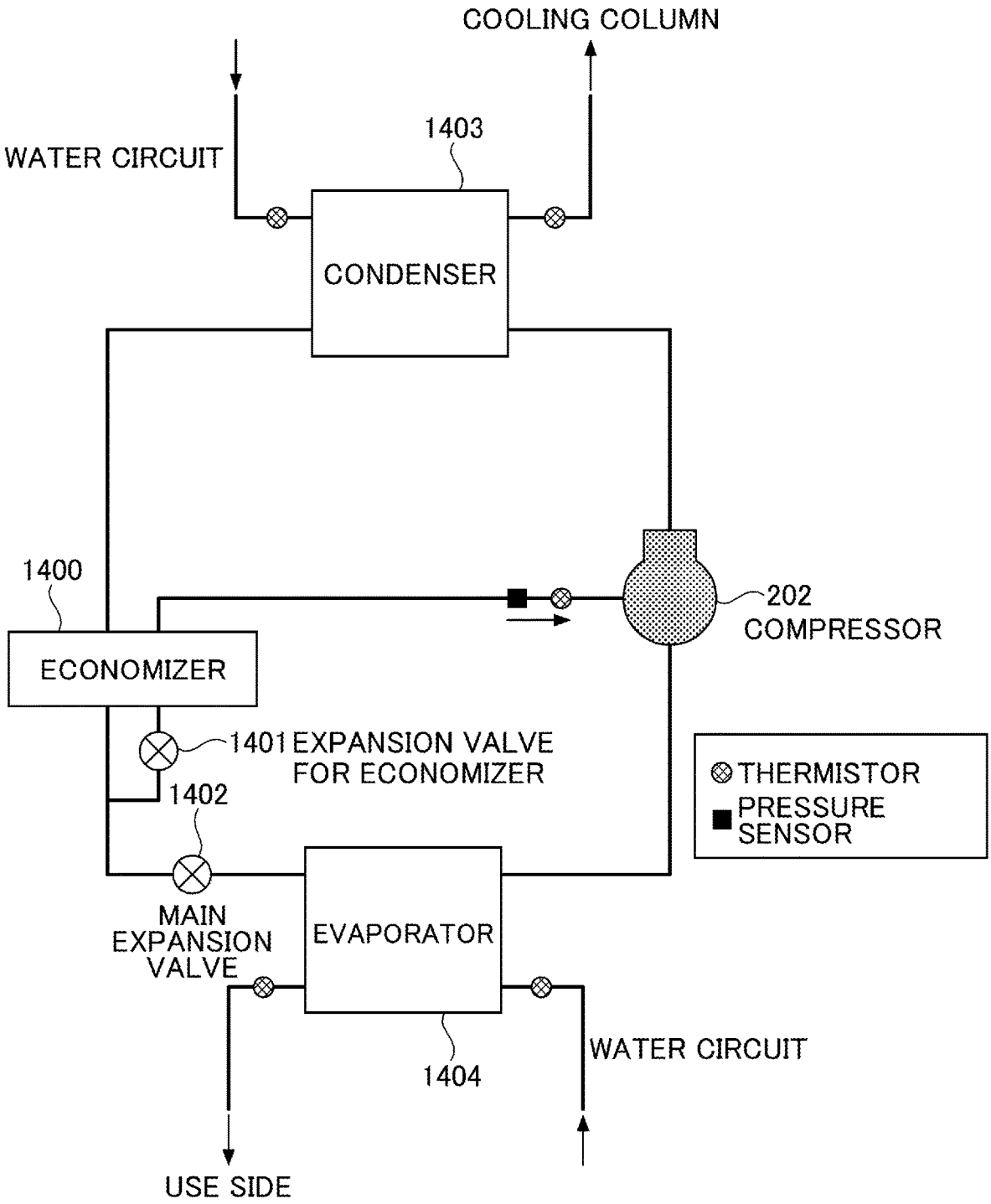
FIG. 14 is an example in which an economizer circuit is provided and at least one of a heat source side and a use side is water cooled according to an embodiment of the present disclosure.

Degree of subcooling at an economizer 1400 outlet (when an economizer circuit is provided (for example, FIG. 14))

Opening degree of an expansion valve 1401 for economizer (when an economizer circuit is provided (for example, FIG. 14))

Outlet pressure of the economizer 1400 bypass side (when an economizer circuit is provided (for example, FIG. 14))

Figure 15:
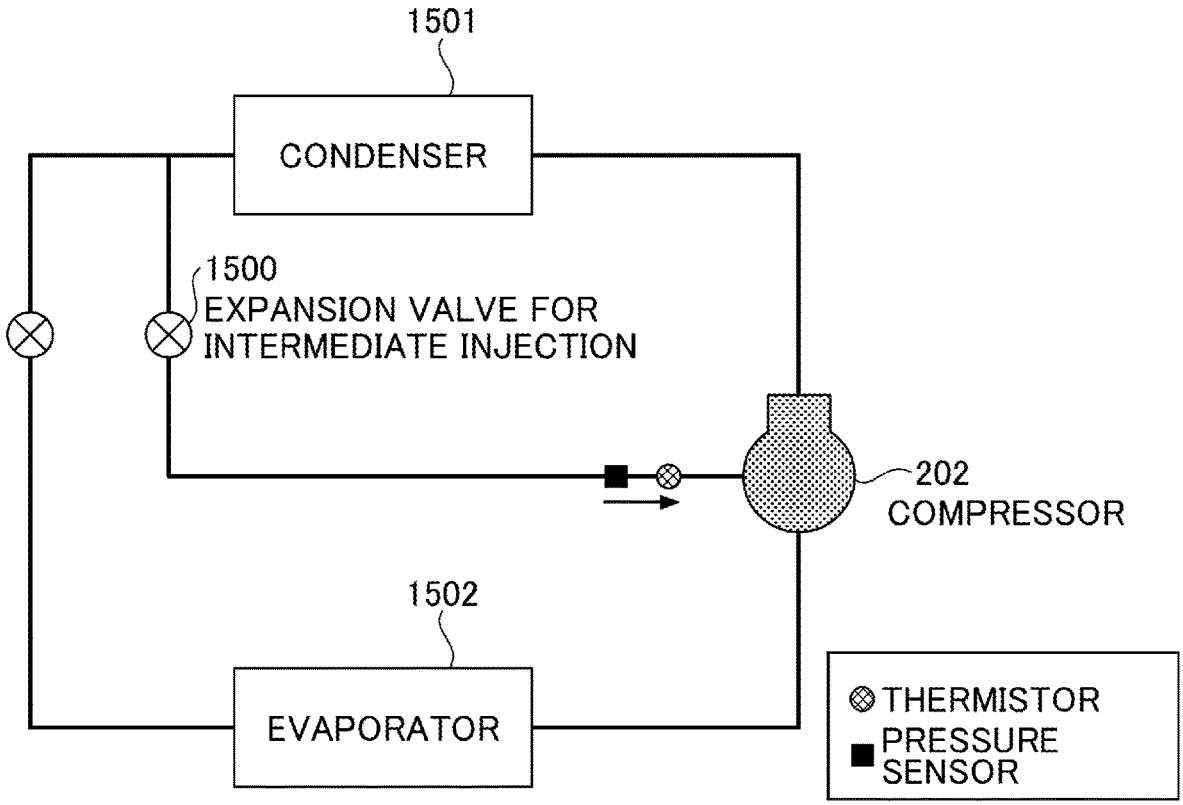
FIG. 15 is an example in which an intermediate injection circuit is provided according to an embodiment of the present disclosure.

Opening degree of the expansion valve 1500 for intermediate injection (when intermediate injection circuit is provided (for example, FIG. 15))

Intermediate injection temperature (when intermediate injection circuit is provided (for example, FIG. 15))

Intermediate injection pressure (when intermediate injection circuit is provided (for example, FIG. 15))

Water temperature of an evaporator 1404 inlet (when at least one of the heat source side and the use side is water cooled (for example, FIG. 14))

Water temperature of the evaporator 1404 outlet (when at least one of the heat source side and the use side is water cooled (for example, FIG. 14))

Water temperature of a condenser 1403 inlet (when at least one of the heat source side and the use side is water cooled (for example, FIG. 14))

Water temperature of the condenser 1403 outlet (when at least one of the heat source side and the use side is water cooled (for example, FIG. 14))

«Operation Data for Inferring Predicted Value of Refrigerant Amount Index Value at Normal Operation (Example 3)»

For example, the operation data for inferring the predicted value of the refrigerant amount index value at the normal operation may include at least one of the values described below, in addition to the operation data (Example 1 and Example 2) described above or in place of the operation data (Example 1 and Example 2) described above.

Number of times of defrosting, or duration of defrosting

<Combination of Refrigerant Amount Index Value and Operation Data for Inferring Predicted Value of Refrigerant Amount Index Value at Normal Operation>

A combination of the refrigerant amount index value and the operation data for inferring the predicted value of the refrigerant amount index value at the normal operation will be described. For example, the refrigerant amount index value (Example 1) and the operation data for inferring the predicted value of the refrigerant amount index value at the normal operation (Example 1) may be used. For example, the refrigerant amount index value (Example 2) and the operation data for inferring the predicted value of the refrigerant amount index value at the normal operation (Example 1) may be used. For example, the refrigerant amount index value (Example 3) and the operation data for inferring the predicted value of the refrigerant amount index value at the normal operation (Example 1) may be used.

Figure 6:
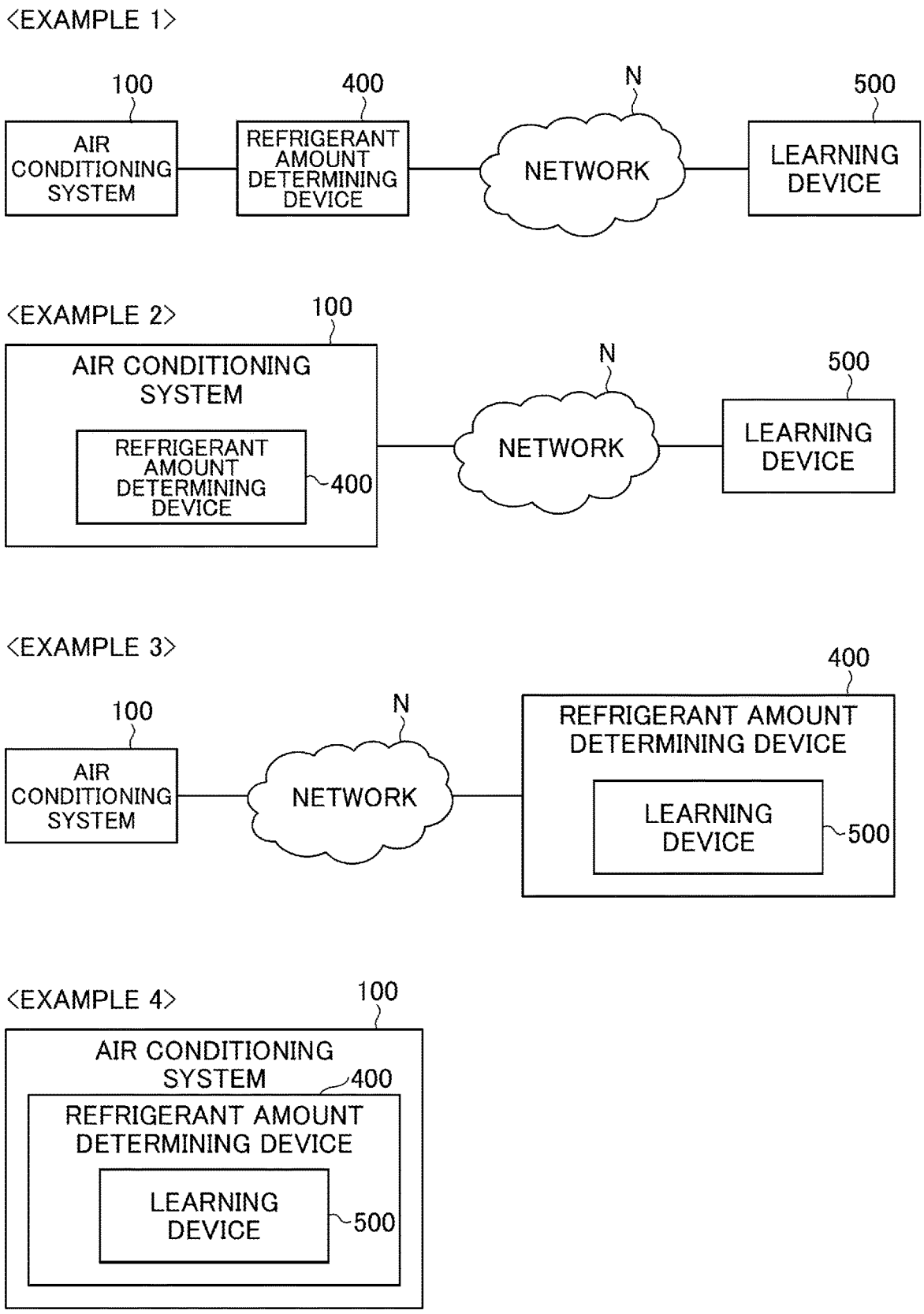
FIG. 6 is a diagram for explaining a relationship between an air conditioning system, a refrigerant amount determining device, and a learning device according to an embodiment of the present disclosure.

FIG. 6 is a diagram for explaining a relationship between the air conditioning system 100, the refrigerant amount determining device 400, and the learning device 500 according to an embodiment of the present disclosure.

As illustrated in <Example 1>, the refrigerant amount determining device 400 may be implemented on a computer installed in, for example, the same building as the air conditioning system 100. The learning device 500 may also be implemented on a cloud server remote from the air conditioning system 100 and the refrigerant amount determining device 400.

As illustrated in <Example 2>, the refrigerant amount determining device 400 may be implemented as part of the air conditioning system 100 (for example, installed in the outdoor unit 200 or in the indoor unit 300). The learning device 500 may also be implemented on a cloud server remote from the air conditioning system 100 and the refrigerant amount determining device 400.

As illustrated in <Example 3>, the refrigerant amount determining device 400 and the learning device 500 may be implemented on a cloud server remote from the air conditioning system 100.

As illustrated in <Example 4>, the refrigerant amount determining device 400 and the learning device 500 may be implemented as part of the air conditioning system 100 (for example, installed in the outdoor unit 200 or in the indoor unit 300).

<Functional Block of Learning Device>

Figure 7:
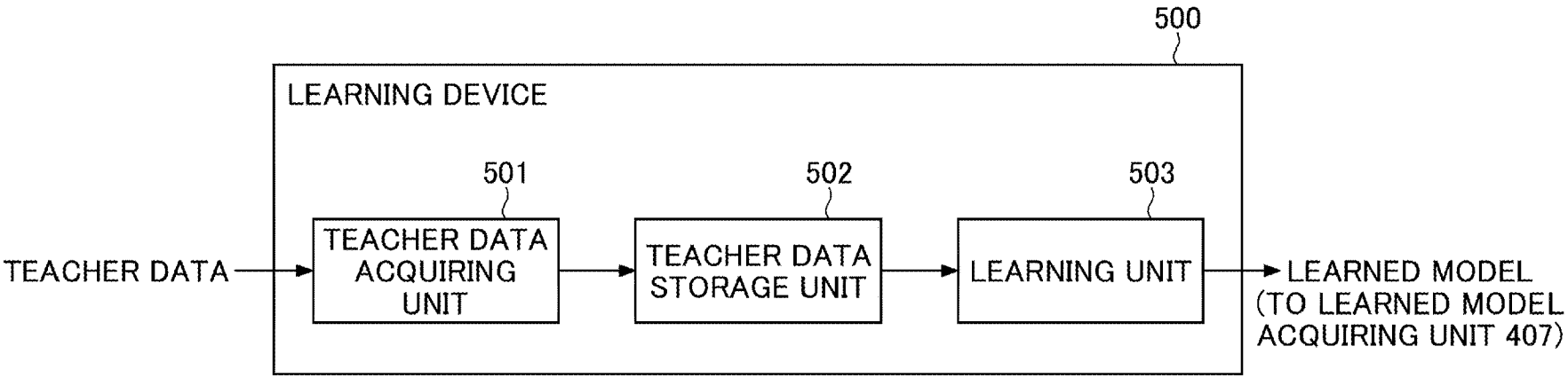
FIG. 7 is a functional block diagram of the learning device according to an embodiment of the present disclosure.

FIG. 7 is a functional block diagram of the learning device 500 according to an embodiment of the present disclosure. The learning device 500 may include a teacher data acquiring unit 501, a teacher data storage unit 502, and a learning unit 503. The learning device 500 may function as the teacher data acquiring unit 501 and the learning unit 503 by executing a program.

The teacher data acquiring unit 501 acquires teacher data. The teacher data acquiring unit 501 stores the acquired teacher data in the teacher data storage unit 502. The teacher data is the operation data and the refrigerant amount index value at the normal operation (that is, when the refrigerant in the air conditioning system 100 is in an appropriate amount (also referred to as an appropriate refrigerant amount)).

The teacher data storage unit 502 stores the teacher data.

The learning unit 503 extracts as learning data, from the operation data at the normal operation of the air conditioning system 100 in which the filled amount of the refrigerant is appropriate and no refrigerant leakage or other failure occurs, only the data of the item having a strong correlation with the refrigerant amount index value. The learning unit 503 performs machine learning by correlating each item with the refrigerant amount index value. The item having a strong correlation with the refrigerant amount index value is, for example, outdoor temperature, a rotation speed of the compressor 202, an opening degree of the expansion valve 204 of the subcooling heat exchanger, a current value of the compressor 202, and the like. As a result of learning using the learning data, a learned model is generated. When test data including the same items as the learned data is input to the learned model, the correlation between each item and the refrigerant amount index value are corrected and the predicted value of the refrigerant amount index value of the air conditioning system 100 at the time of acquiring the test data is output. The learned data need not necessarily be extracted from the operation data at the normal operation of the air conditioning system in which the refrigerant amount index value is to be predicted. The learned data may be extracted from the operation data at the normal operation of another air conditioning system, or may be extracted from the operation data at the normal operation of multiple air conditioning systems. To create learned models, machine learning algorithms such as random forests and support vector machines may be used.

<Refrigerant Leakage Determination Using Refrigerant Amount Index Value>

Hereinafter, the refrigerant leakage determination using the refrigerant amount index value in the refrigerant amount determining device 400 will be described with reference to FIG. 9.

Figure 9:
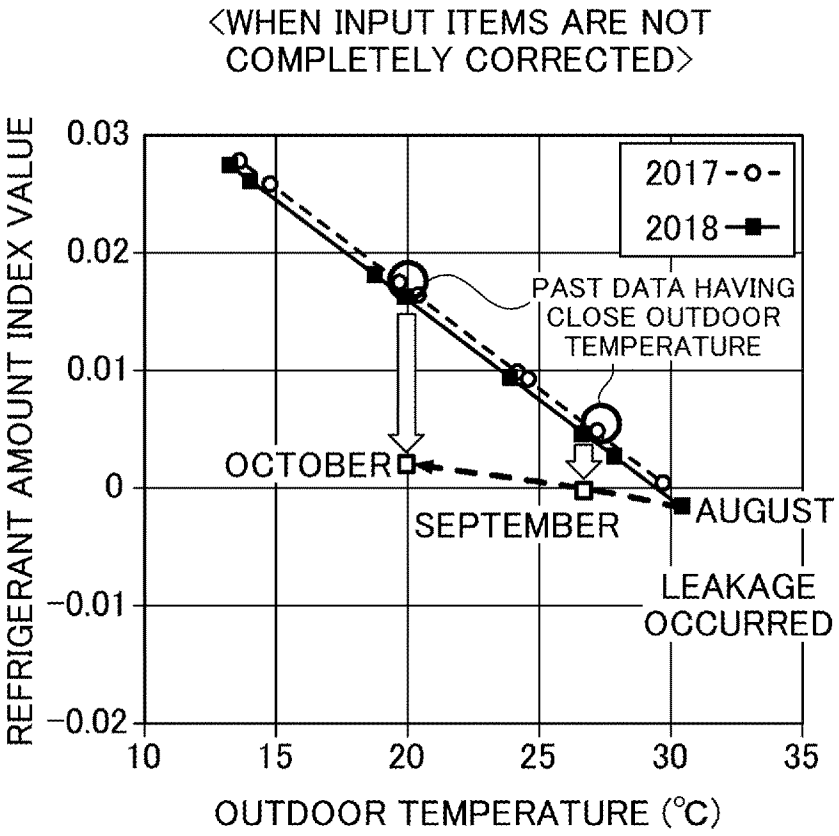
FIG. 9 is a diagram for explaining a refrigerant leakage determination using the refrigerant amount index value according to an embodiment of the present disclosure.
Figure 9:
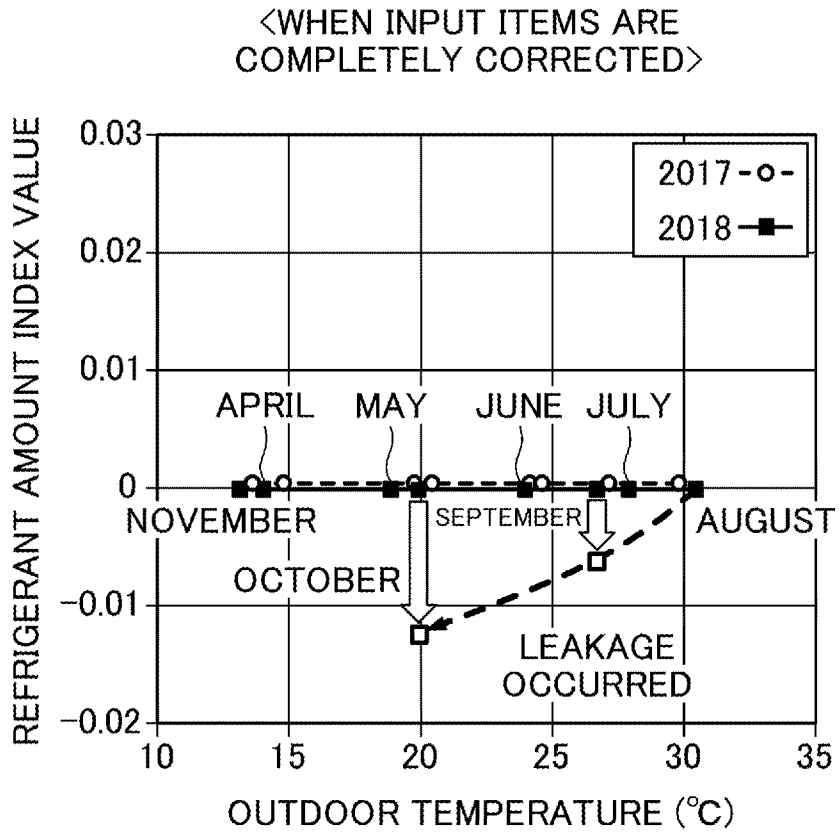

FIG. 9 is a diagram for explaining a refrigerant leakage determination using the refrigerant amount index value according to an embodiment of the present disclosure. The left side of FIG. 9 illustrates the case where the learned model has completely corrected for the effects of the input items, and the right side of FIG. 9 illustrates the case where the learned model has not completely corrected for the effects of the input items (that is, the learned model has not corrected for the effects of at least some of the input items; in the example of FIG. 9, correction for the outdoor temperature is insufficient). In the following, the outdoor temperature will be described as an example, but the input item that is not completely corrected may be any item such as the outdoor temperature, the rotation speed of the compressor, and the like.

«When Input Items are Completely Corrected»

On the left side of FIG. 9 (when the input items are completely corrected), when the refrigerant is not leaked, the difference or ratio (in the case of FIG. 9, Δ refrigerant amount index value) between the current refrigerant amount index value (that is, the calculated refrigerant amount index value) and the predicted value of the refrigerant amount index value at the normal operation is a constant value (for example, a value near zero). As illustrated in FIG. 9, when plotting the Δ refrigerant amount index value on a monthly average with the horizontal axis as the outdoor temperature, the Δ refrigerant amount index value moves to the right with a constant value from April to August 2018, turns back in August, and moves to the left with a constant value until November. In addition, the transition of Δ refrigerant amount index value (transition of Δ refrigerant amount index value in 2018 in the example of FIG. 9) coincides with the transition of Δ refrigerant amount index value in the past (transition of Δ refrigerant amount index value in 2017 in the example of FIG. 9).

Suppose that refrigerant leakage occurred after August 2018 (square dots in FIG. 9). The A refrigerant amount index value is zero at the normal operation. Therefore, it is possible to determine the leakage of refrigerant only by the Δ refrigerant amount index value in September and October, in which the Δ refrigerant amount index value is negative.

«When Input Items are Not Completely Corrected»

On the right side of FIG. 9 (when the input items are not completely corrected), the Δ refrigerant amount index value decreases as the outdoor temperature increases even when the refrigerant is not leaking. As illustrated in FIG. 9, when plotting the Δ refrigerant amount index value on a monthly average with the horizontal axis as the outdoor temperature, the Δ refrigerant amount index value declines from April to August as the outdoor temperature increases, turns back in August, and rises until November as the outdoor temperature decreases. The change in the difference or ratio (A refrigerant amount index value in the example of FIG. 9) between the current refrigerant amount index value (that is, calculated refrigerant amount index value) and the predicted value of the refrigerant amount index value at the normal operation, with respect to the change in operating conditions (outdoor temperature in the example of FIG. 9), is reproducible. Therefore, the transition of Δ refrigerant amount index value (the transition of Δ refrigerant amount index value in 2018 in the example of FIG. 9) coincides with the transition of Δ refrigerant amount index value in the past (the transition of Δ refrigerant amount index value in 2017 in the example of FIG. 9).

Suppose that refrigerant leakage occurred after August 2018 (square dots in FIG. 9). The Δ refrigerant amount index value changes due to the influence of the outdoor temperature. Therefore, the leakage of refrigerant cannot be determined only by the Δ refrigerant amount index value in September and October. Thus, the leakage of refrigerant is determined by comparing the Δ refrigerant amount index value in the past (for example, in the first half of 2018 or in 2017), which was close to the operating condition (outdoor temperature in the example of FIG. 9) at the time of determination, with the current Δ refrigerant amount index value.

That is, when the input item is not completely corrected, the determining unit 404 determines the refrigerant amount of the air conditioning system based on both the difference or ratio between "the refrigerant amount index value calculated by the calculating unit 402" and "the predicted value of the refrigerant amount index value at the normal operation inferred by the inferring unit 403" or the difference or ratio between "the refrigerant amount index value calculated from the operating conditions when the operation data for calculating the refrigerant amount index value were obtained and from the past operation data that was obtained when the operating conditions were in a predetermined range" and "the predicted value of the refrigerant amount index value at the normal operation inferred by the inferring unit 403". The determination using past operation data may be performed independently or after the determination not using past operation data is performed.

<Determination of Refrigerant Amount>

Hereinafter, a specific example of determination of the refrigerant amount will be described. As described above, the determining unit 404 determines the refrigerant amount of the air conditioning system 100 based on the difference or ratio between the refrigerant amount index value calculated by the calculating unit 402 and the predicted value of the refrigerant amount index value at the normal operation inferred by the inferring unit 403.

«Determination (Example 1)»

The determining unit 404 may determine the degree of increase or decrease of the refrigerant (for example, the degree of leakage of the refrigerant amount) from the appropriate refrigerant amount based on the difference or ratio between the refrigerant amount index value calculated by the calculating unit 402 and the predicted value of the refrigerant amount index value at the normal operation inferred by the inferring unit 403.

«Determination (Example 2)»

The determining unit 404 may determine the ratio of the leakage amount to the appropriate amount of refrigerant (for example, xx % of the refrigerant of the total refrigerant amount is leaked) based on the difference or ratio between the refrigerant amount index value calculated by the calculating unit 402 and the predicted value of the refrigerant amount index value at normal operation inferred by the inferring unit 403 and on the appropriate refrigerant amount of the air conditioning system 100. The determining unit 404 may be configured to determine the refrigerant amount (for example, "the current refrigerant amount is xx kg").

Figure 10:
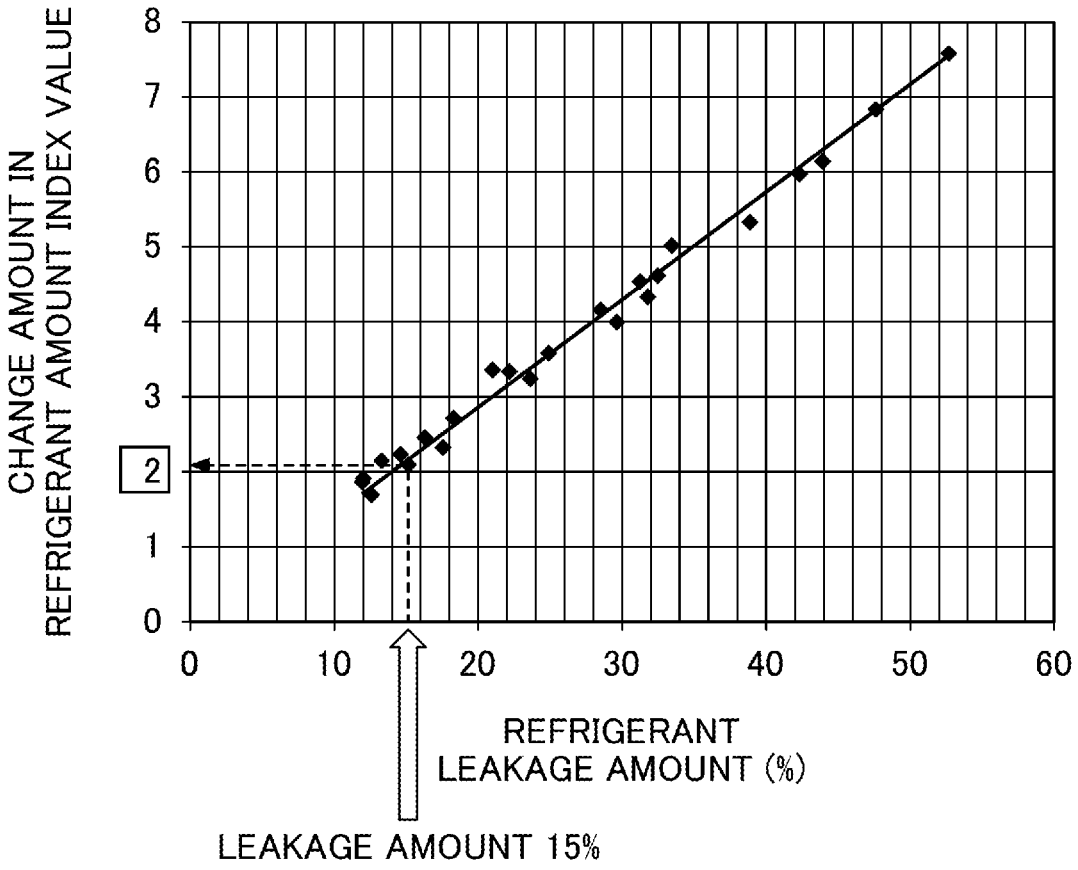
FIG. 10 is a diagram for explaining a determination of a refrigerant amount according to an embodiment of the present disclosure.

FIG. 10 is a diagram for explaining determination of the refrigerant amount according to an embodiment of the present disclosure. The refrigerant amount determining device 400 stores the correspondence between the change amount in the refrigerant amount index value (that is, the difference or ratio between the current refrigerant amount index value and the predicted value of the refrigerant amount index value at the normal operation) and the ratio of leakage amount to the appropriate amount of the refrigerant, as illustrated in FIG. 10. For example, suppose that average of change amount in the refrigerant amount index value is 2 when 15% of the total refrigerant amount has leaked. Thus, the refrigerant amount determining device 400 may determine that 15% of the total refrigerant amount has leaked when the change amount in the refrigerant amount index value is 2.

<Processing Method>

Hereinafter, a determination process and a learning process according to an embodiment of the present disclosure will be described.

Figure 11:
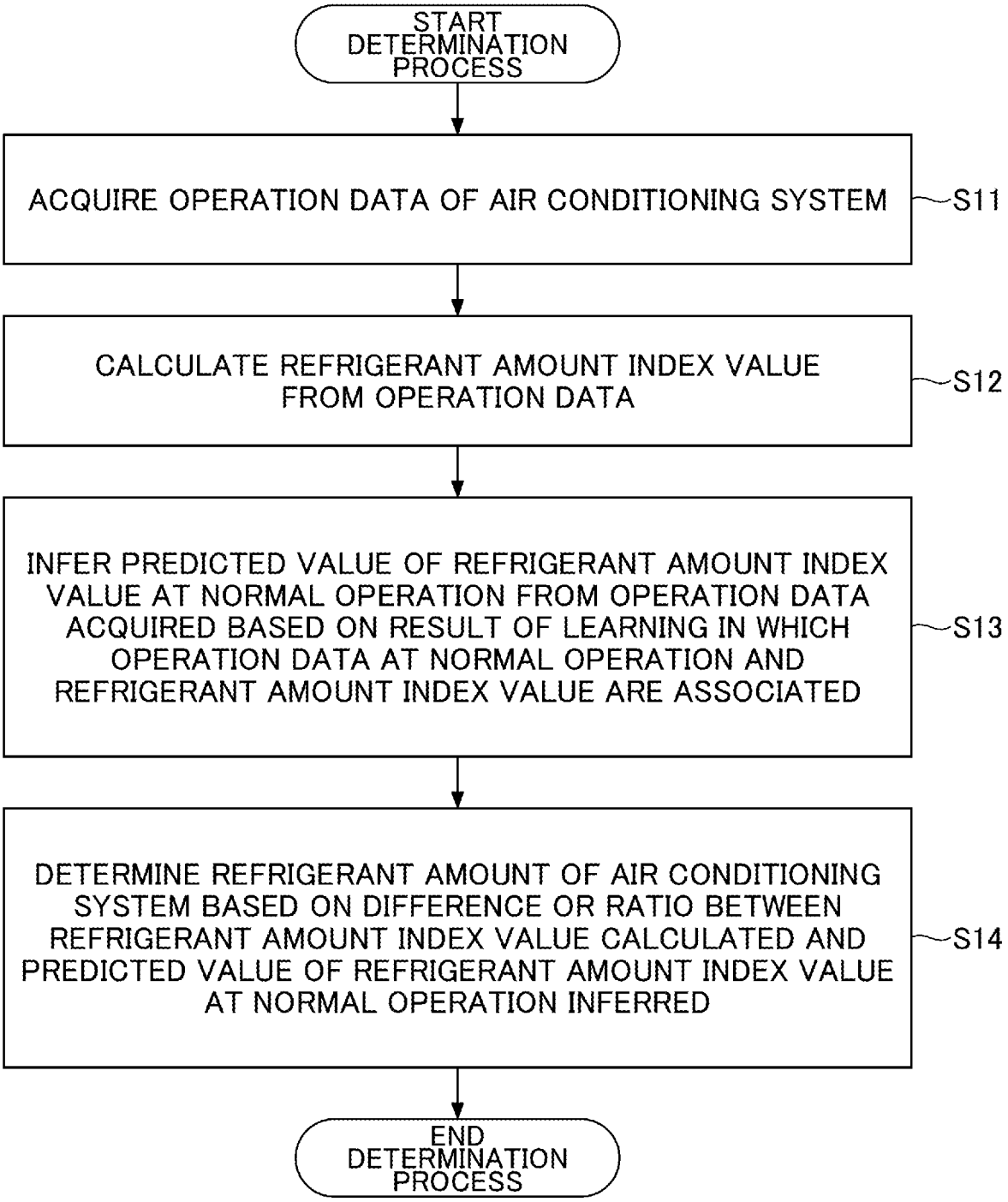
FIG. 11 is a flowchart of a determination process according to an embodiment of the present disclosure.

FIG. 11 is a flowchart of the determination process according to an embodiment of the present disclosure.

In Step 11 (S11), the operation data acquiring unit 401 acquires operation data of the air conditioning system 100 from various sensors (temperature sensors, pressure sensors, and the like) of the air conditioning system 100.

In Step 12 (S12), the calculating unit 402 calculates the refrigerant amount index value from the operation data acquired by the operation data acquiring unit 401 in S11.

In Step 13 (S13), the inferring unit 403 infers the predicted value of the refrigerant amount index value at the normal operation from the operation data acquired by the operation data acquiring unit 401 in S11, based on the result of learning (the learned model 406) in which the operation data at the normal operation is associated with the refrigerant amount index value.

The order of S12 and S13 may be reversed.

In Step 14 (S14), the determining unit 404 determines the refrigerant amount of the air conditioning system 100 based on a difference or a ratio between the refrigerant amount index value calculated by the calculating unit 402 in S12 and the predicted value of the refrigerant amount index value at the normal operation inferred by the inferring unit 403 in S13. Thereafter, the outputting unit 405 may output the result determined by the determining unit 404.

Figure 12:
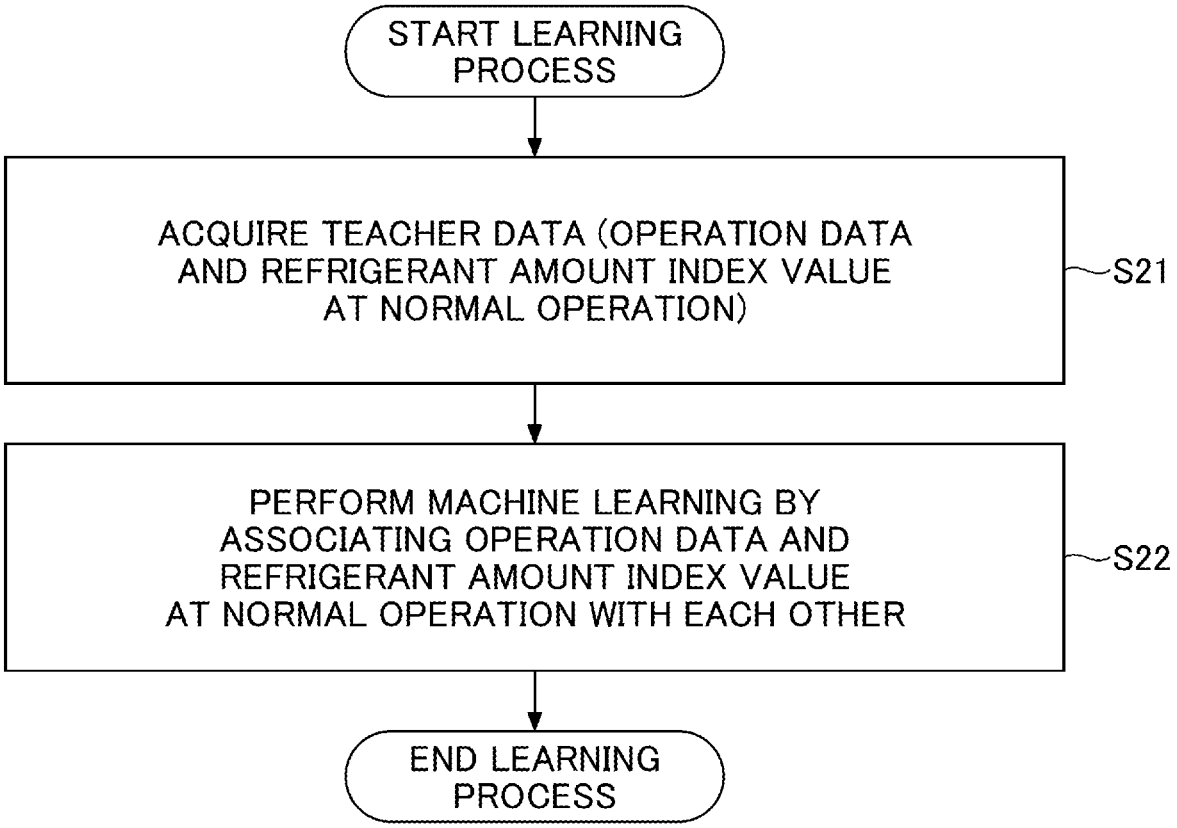
FIG. 12 is a flowchart of a learning process according to an embodiment of the present disclosure.

FIG. 12 is a flowchart of the learning process according to an embodiment of the present disclosure.

In Step 21 (S21), the teacher data acquiring unit 501 acquires teacher data (operation data and a refrigerant amount index value at normal operation). The teacher data acquiring unit 501 stores the acquired teacher data in the teacher data storage unit 502.

In step 22 (S22), the learning unit 503 performs machine learning by associating the operation data and the refrigerant amount index value at the normal operation with each other. The learned model is generated as a result of learning by associating the operation data and the refrigerant amount index value at the normal operation with each other.

Hereinafter, various embodiments of the refrigerant amount determination will be described. As described below, the inferring unit 403 may infer information regarding correction of the refrigerant amount index value using at least one of the operation data acquired by the operation data acquiring unit 401 and the refrigerant amount index value calculated by the calculating unit 402, and a learned model (also referred to as a correction model). The determining unit 404 may determine the refrigerant amount of the air conditioning system 100 based on information regarding correction of the refrigerant amount index value.

The data entered into the correction model may be only the refrigerant amount index value calculated from the operation data, or only the operation data. In the correction model, the same data as used to calculate the refrigerant amount index value may be, used, or data different from the data used to calculate the refrigerant amount index value may be used, or data partially same as the data used to calculate the refrigerant amount index value may be used. The data entered into the correction model may be both the refrigerant amount index value and the operation data.

The "information regarding correction of the refrigerant amount index value" output from the correction model may be, for example, as follows: the corrected refrigerant amount index value; corrected range of the refrigerant amount index value; information for specifying the corrected refrigerant amount index value (for example, coefficients a and b of linear correction formula ym(t)=a*y(t)+b when the corrected refrigerant amount index value is ym(t)); and the like.

Figure 16:
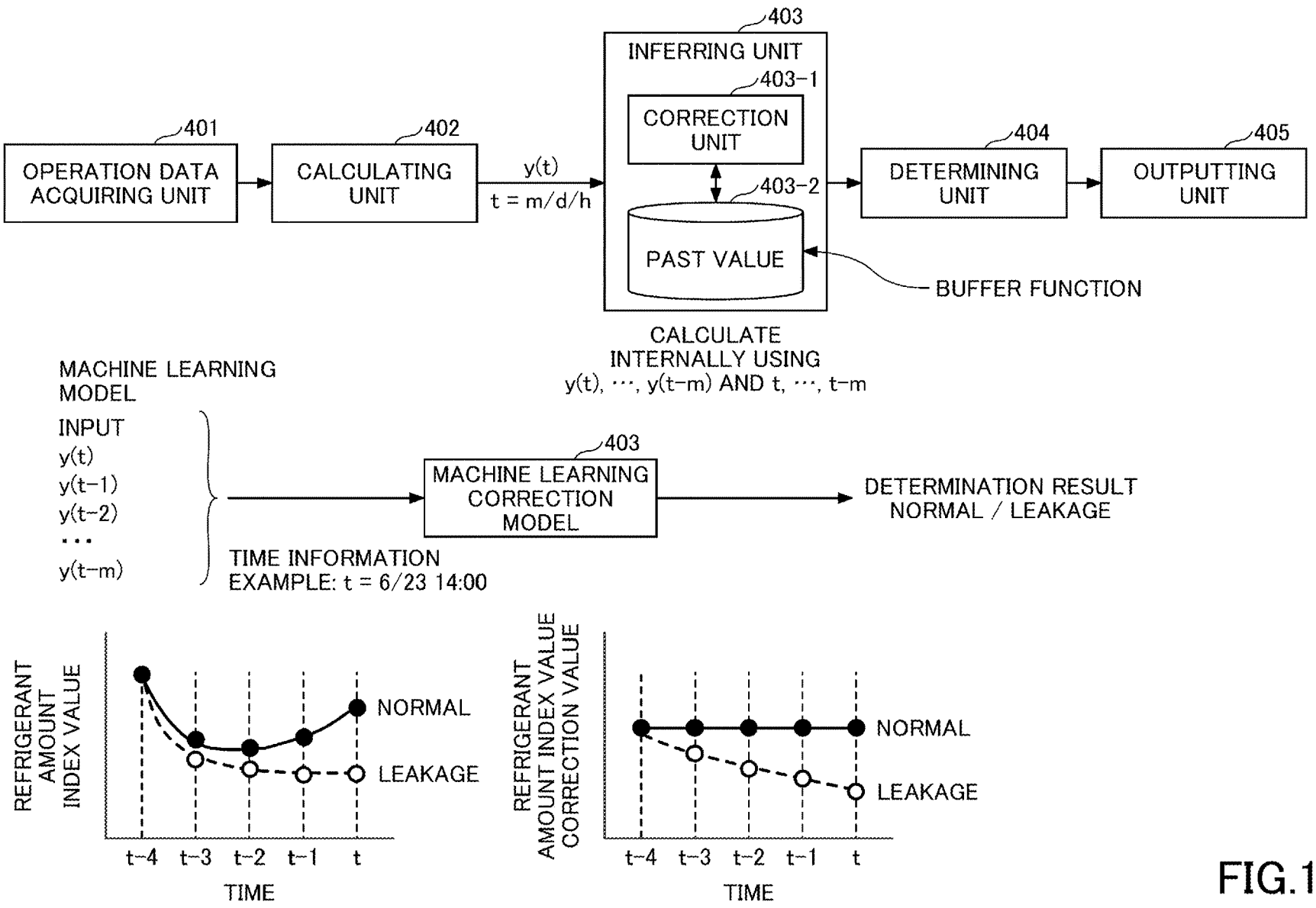
FIG. 16 is a diagram illustrating a refrigerant amount determining device according to an embodiment of the present disclosure.

FIG. 16 is a diagram for explaining the refrigerant amount determining device 400 according to an embodiment of the present disclosure. In the embodiment illustrated in FIG. 16, the inferring unit 403 infers the corrected refrigerant amount index value using the refrigerant amount index value calculated by the calculating unit 402 and the correction model. The corrected refrigerant amount index value is a value in which the refrigerant amount index value calculated by the calculating unit 402 is corrected. The determining unit 404 determines the refrigerant amount of the air conditioning system 100 based on the corrected refrigerant amount index value.

Specifically, the inferring unit 403 includes a correction unit 403-1 and a past value (buffer function) 403-2. The past value 403-2 stores the past refrigerant amount index value (y(t−1), . . . , y(t−m), . . . ). The past refrigerant amount index value is accompanied by time information (t−1, . . . , t−m, . . . ) including date information (information on the month and day when the refrigerant amount index value was acquired). The correction unit 403-1 acquires the refrigerant amount index value (y(t)) accompanied by the time information (t) from the calculating unit 402, and acquires the past refrigerant amount index value (y(t−1), y(t−2)) from the past value 403-2 using the acquired date information. The correction unit 403-1 sets the present value as Expression 1 described below.

[Expression 1]

$$Y(t) = \begin{bmatrix} y(t) \\ y(t-1) \\ y(t-2) \end{bmatrix} \tag{1}$$

The correction unit 403-1 acquires the data of the same time of the previous year corresponding to (y(t), y(t−1), and y(t−2)) from the past value 403-2, using the date information acquired in the same manner. The correction unit 403-1 defines a variable as Expression 2 described below.

[Expression 2]

$$Y^*(t) = \begin{bmatrix} y^*(t) \\ y^*(t-1) \\ y^*(t-2) \end{bmatrix} \tag{2}$$

In the expression, y*(t) is the refrigerant amount index value of y(t) at the same time of the previous year. The inner product of Y(t) and Y*(t) defined in this manner may be used as the correction value of the refrigerant amount index value. That is, the inferring unit 403 may output the corrected refrigerant amount index value by inputting y(t) and past values y(t−1), . . . , y(t−m) up to t−m (here, m=2) and past values y*(t−1), . . . , y*(t−m) at the same time of the previous year into the correction model. Using such a corrected refrigerant amount index value facilitates the determination of refrigerant leakage, as illustrated in the graph of FIG. 16.

Figure 17:
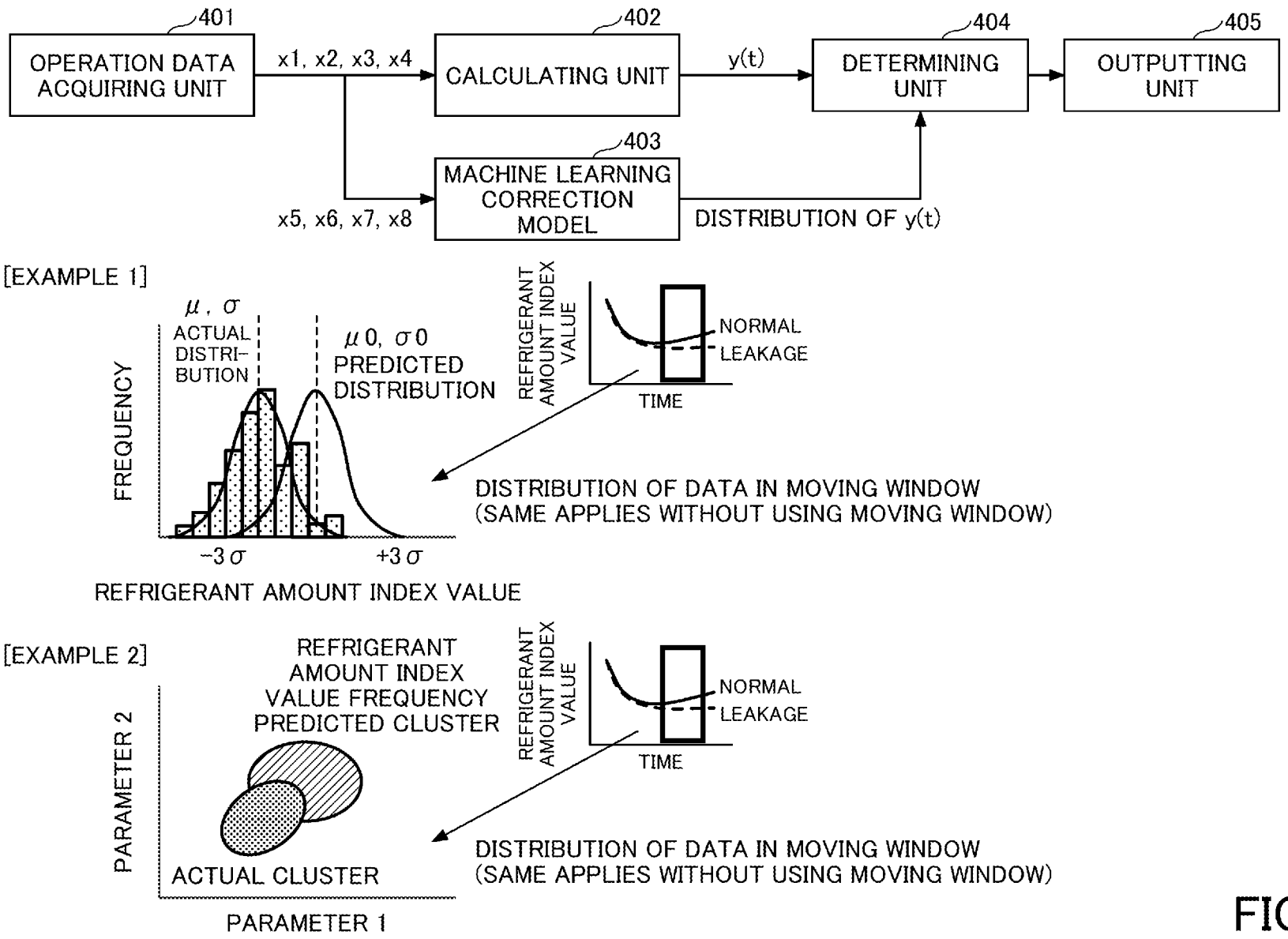
FIG. 17 is a diagram illustrating a refrigerant amount determining device according to an embodiment of the present disclosure.

FIG. 17 is a diagram for explaining the refrigerant amount determining device 400 according to an embodiment of the present disclosure. In the embodiment illustrated in FIG. 17, the operation data includes first operation data and second operation data. The first operation data and the second operation data are at least partially different, or the first operation data and the second operation data are at least partially identical. The calculating unit 402 calculates the refrigerant amount index value from the first operation data. The inferring unit 403 infers the corrected range of the refrigerant amount index value using the second operation data and the correction model. The determining unit 404 determines the refrigerant amount of the air conditioning system 100 based on the refrigerant amount index value calculated by the calculating unit 402 and the corrected range of the refrigerant amount index value. Specifically, the determining unit 404 evaluates whether or not the present value of the refrigerant amount index value calculated by the calculating unit 402 is within the range inferred by the inferring unit 403, and determines the leakage of the refrigerant. The range is, for example, an upper and lower limit (a<y(t)<b at normal operation and p<y(t)<q at abnormal operation, distribution ranges (a,b) and (p,q) and the like), a distribution model, cluster, and the like

EXAMPLE 1

The inferring unit 403 outputs the predicted distribution of the refrigerant amount index value in a normal state or in an abnormal state (leakage state). For example, a predicted distribution obtained by approximating with a normal distribution (predicted statistical parameters: $\mu 0$, $\sigma 0$ (characteristic parameters of the distribution corrected by the correction model)) and an actual distribution (actual statistical parameters: $\mu$, $\sigma$) as illustrated in FIG. 17 are supposed. The determining unit 404 determines the leakage of the refrigerant based on the relationship between the predicted distribution and the actual distribution (for example, evaluation of the deviation of parameters, evaluation of the appearance rate outside the $-3\sigma$ range, and the like).

EXAMPLE 2

The inferring unit 403 outputs a predicted cluster of the refrigerant amount index value in a normal state or in an abnormal state (leakage state). For example, a predicted cluster (a cluster corrected by the correction model) and an actual cluster as illustrated in FIG. 17 are supposed. The determining unit 404 determines the leakage of refrigerant based on the relationship between the predicted cluster and the actual cluster.

EXAMPLE 3

In <Example 1> and <Example 2>, instead of the corrected range of the refrigerant amount index value, information for specifying the corrected refrigerant amount index value (for example, coefficients a and b of linear correction formula ym(t)=a*y(t)+b when the corrected refrigerant amount index value is ym(t)) may be used.

Figure 18:
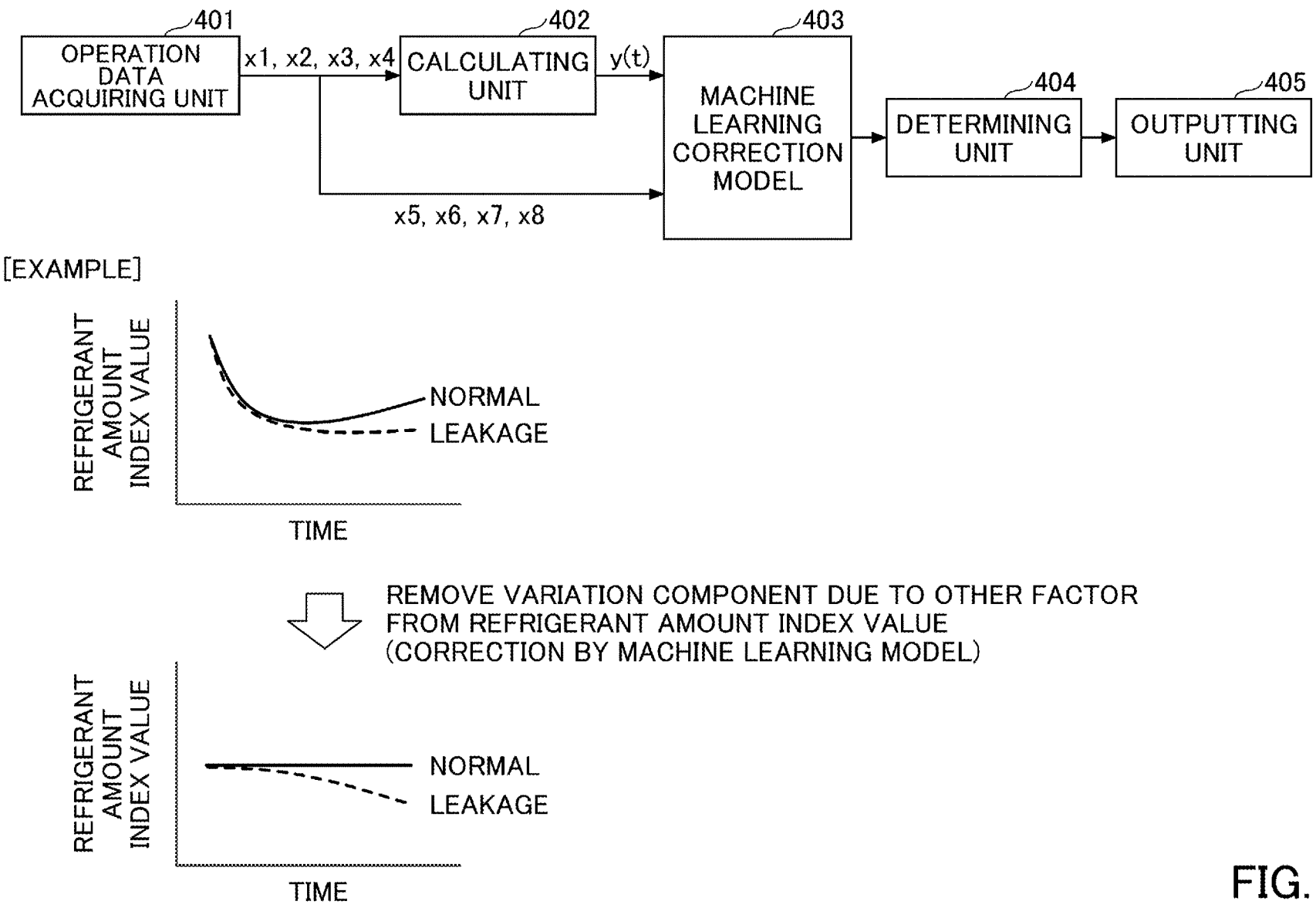
FIG. 18 is a diagram illustrating a refrigerant amount determining device according to an embodiment of the present disclosure.

FIG. 18 is a diagram for explaining the refrigerant amount determining device 400 according to an embodiment of the present disclosure. In the embodiment illustrated in FIG. 18, the operation data includes first operation data and second operation data. The first operation data and the second operation data are at least partially different, or the first operation data and the second operation data are at least partially identical. The calculating unit 402 calculates the refrigerant amount index value from the first operation data. The inferring unit 403 infers the corrected refrigerant amount index value using the second operation data, the refrigerant amount index value calculated by the calculating unit 402, and the correction model. The corrected refrigerant amount index value is a value in which the refrigerant amount index value calculated by the calculating unit 402 is corrected. The determining unit 404 determines the refrigerant amount of the air conditioning system 100 based on the corrected refrigerant amount index value. Specifically, the inferring unit 403 may remove the variation component due to other factors from the refrigerant amount index value by correction by the correction model. Hereinafter, the details will be described with reference to FIG. 19.

Figure 19:
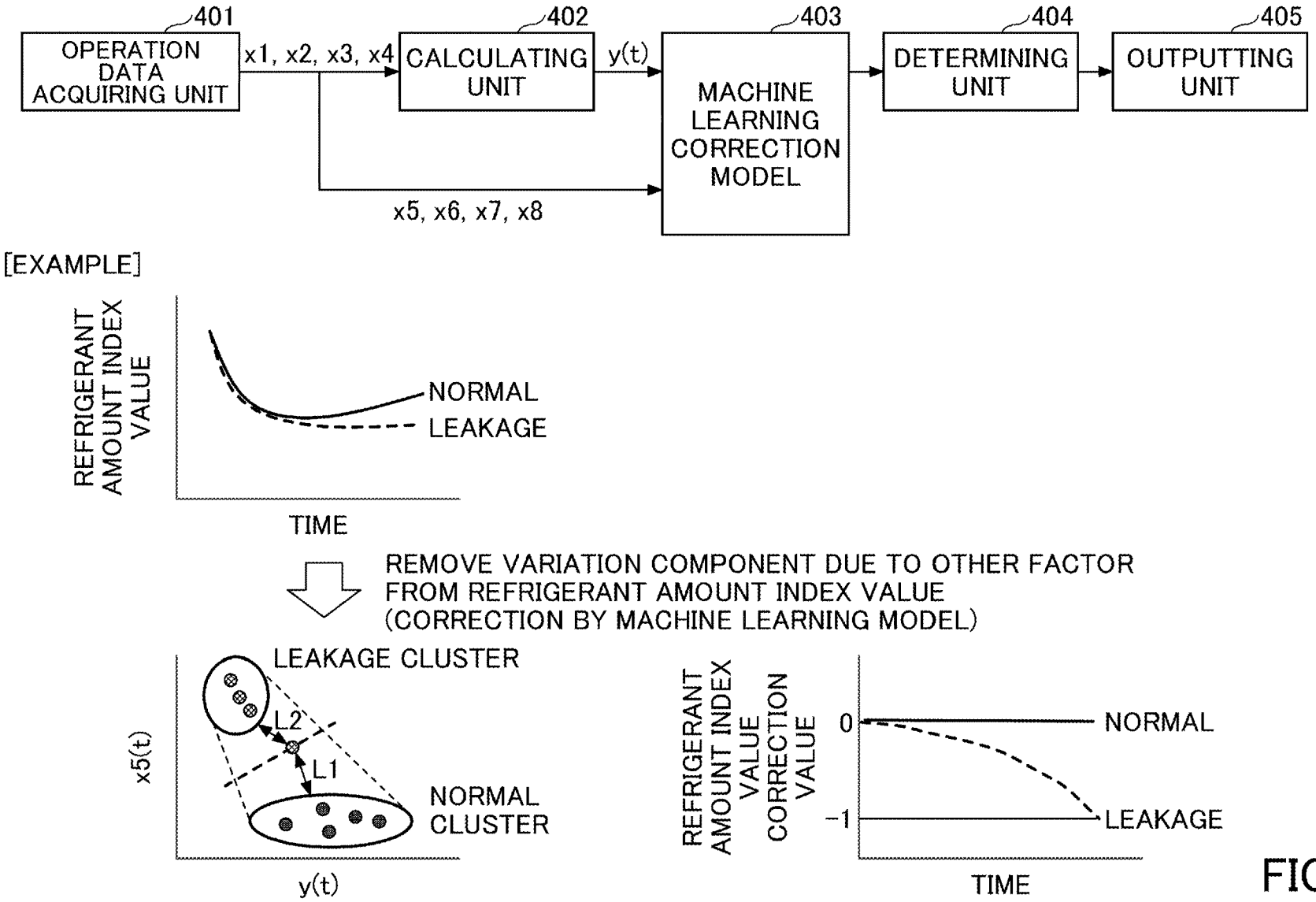
FIG. 19 is a diagram illustrating a refrigerant amount determining device according to an embodiment of the present disclosure.

FIG. 19 is a diagram for explaining the refrigerant amount determining device 400 according to an embodiment of the present disclosure. The inferring unit 403 maps the refrigerant amount index value y(t) calculated by the calculating unit 402 and the operation data x5(t) acquired by the operation data acquiring unit 401 onto the y(t)−x5(t) plane. On the plane, a cluster of normal conditions and a cluster of abnormal conditions (leakage conditions), which are previously learned, are defined. For example, x5 is the opening degree of the expansion valve of the subcooling heat exchanger. The correction value for the refrigerant amount index value is defined as follows.

(1) Point (y(t), x5(t)) is inside the cluster of normal conditions

Correction value of refrigerant amount index value=0

(2) Point (y(t), x5(t)) is outside the cluster of normal conditions and the cluster of abnormal conditions (leakage conditions)

Correction value of refrigerant amount index value=−L1/(L1+L2)

L1: Minimum distance from boundary of the cluster of normal conditions to the point L2: Minimum distance from boundary of the cluster of abnormal conditions (leakage conditions) to the point (3) Point (y(t), x5(t)) is inside the cluster of abnormal conditions (leakage conditions)

Correction value of refrigerant amount index value=−1

Figure 20:
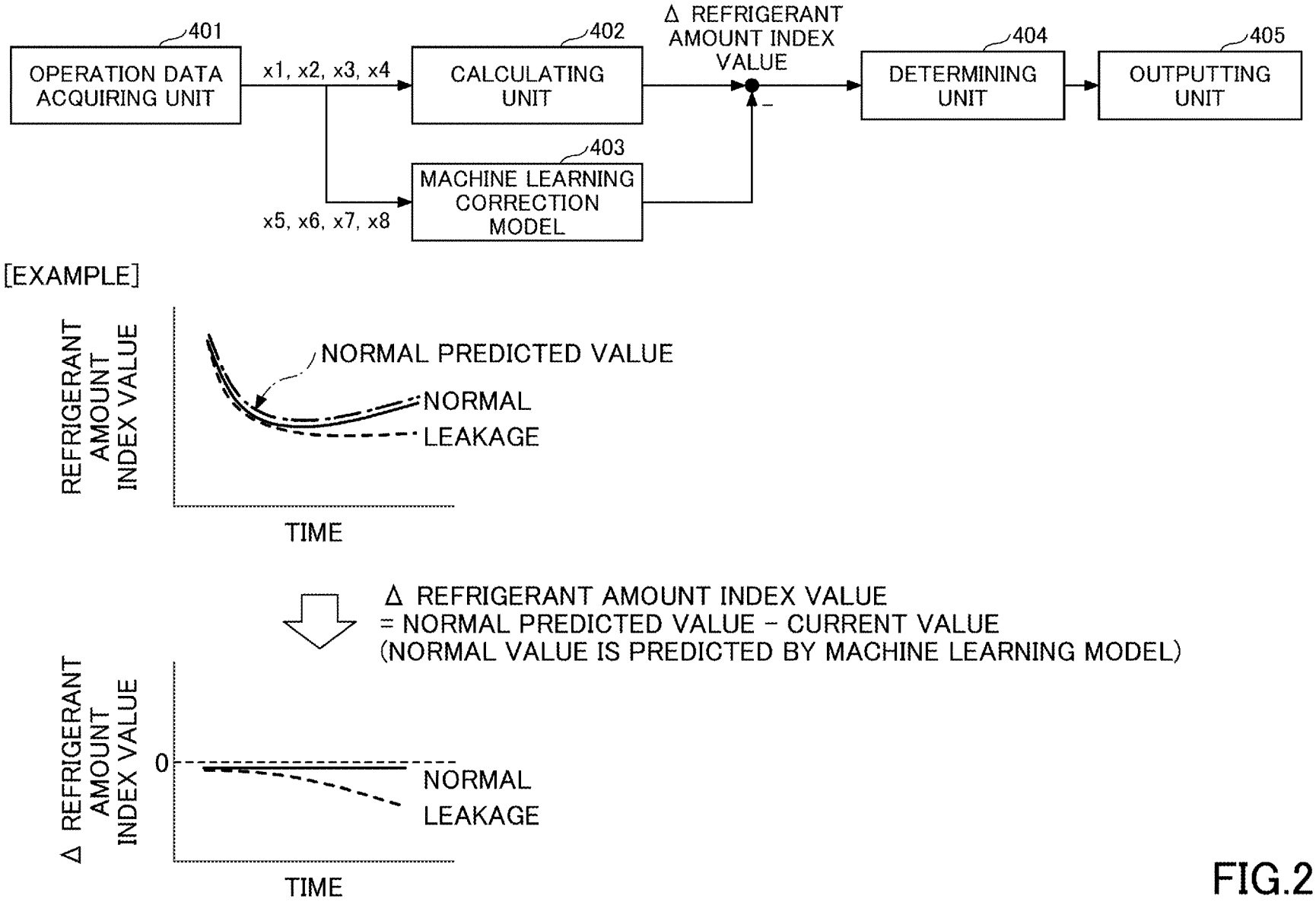
FIG. 20 is a diagram illustrating a refrigerant amount determining device according to an embodiment of the present disclosure.

FIG. 20 is a diagram for explaining the refrigerant amount determining device 400 according to an embodiment of the present disclosure. In the embodiment illustrated in FIG. 20, the operation data includes first operation data and second operation data. The first operation data and the second operation data are at least partially different, or the first operation data and the second operation data are at least partially identical. The calculating unit 402 calculates the refrigerant amount index value from the first operation data. The inferring unit 403 infers a corrected difference or ratio between the refrigerant amount index value calculated by the calculating unit 402 and the predicted value of the refrigerant amount index value predicted from the second operation data using the second operation data, the refrigerant amount index value calculated by the calculating unit 402, and the correction model. The determining unit 404 determines the refrigerant amount of the air conditioning system 100 based on the corrected difference or ratio. As illustrated in FIG. 20, a normal value may be predicted by the correction model. An equation may be provided: correction value of refrigerant amount index value=normal predicted value−present value.

One or more refrigerant amount index values and one or more correction models may be used. For example, the embodiment of FIG. 20 (in which a corrected difference or ratio between the refrigerant amount index value and the predicted value is used) and the embodiment of FIG. 17 (in which a corrected range of the refrigerant amount index value is used) may be combined (that is, one refrigerant amount index value and two correction models). For example, the embodiment of FIG. 20 (in which a corrected difference or ratio between the refrigerant amount index value and the predicted value is used) and FIGS. 18 and 19 (in which a corrected refrigerant amount index value is used) may be combined (that is, there is one refrigerant amount index value and two correction models; the refrigerant amount index value may be more than one). Alternatively, for example, multiple refrigerant amount index values may be used as a variation of the embodiment of FIG. 20 (in which a corrected difference or ratio between the refrigerant amount index value and the predicted value is used).

«Data Set for Learning»

The correction model is a model learned by correlating the refrigerant amount index value with operation data at at least one of normal operation and abnormal operation (that is, normal state only, abnormal state only (leakage state), normal state and abnormal state (with distinction), normal state and abnormal state (without distinction)).

The operation data at at least one of normal operation and abnormal operation includes at least one of measured data and pseudo data (that is, only the measured data, only the pseudo data, the measured data and the pseudo data). When the learning data is insufficient, or when the normal data amount and the abnormal data amount are uneven, the accuracy of the correction may be low. Therefore, it is possible to inflate the data amount by creating pseudo normal data and pseudo abnormal data from existing data.

«Output Correction»

The refrigerant amount determining device 400 may further include an output correction unit that corrects the information regarding correction of the refrigerant amount index value.

Figure 21:
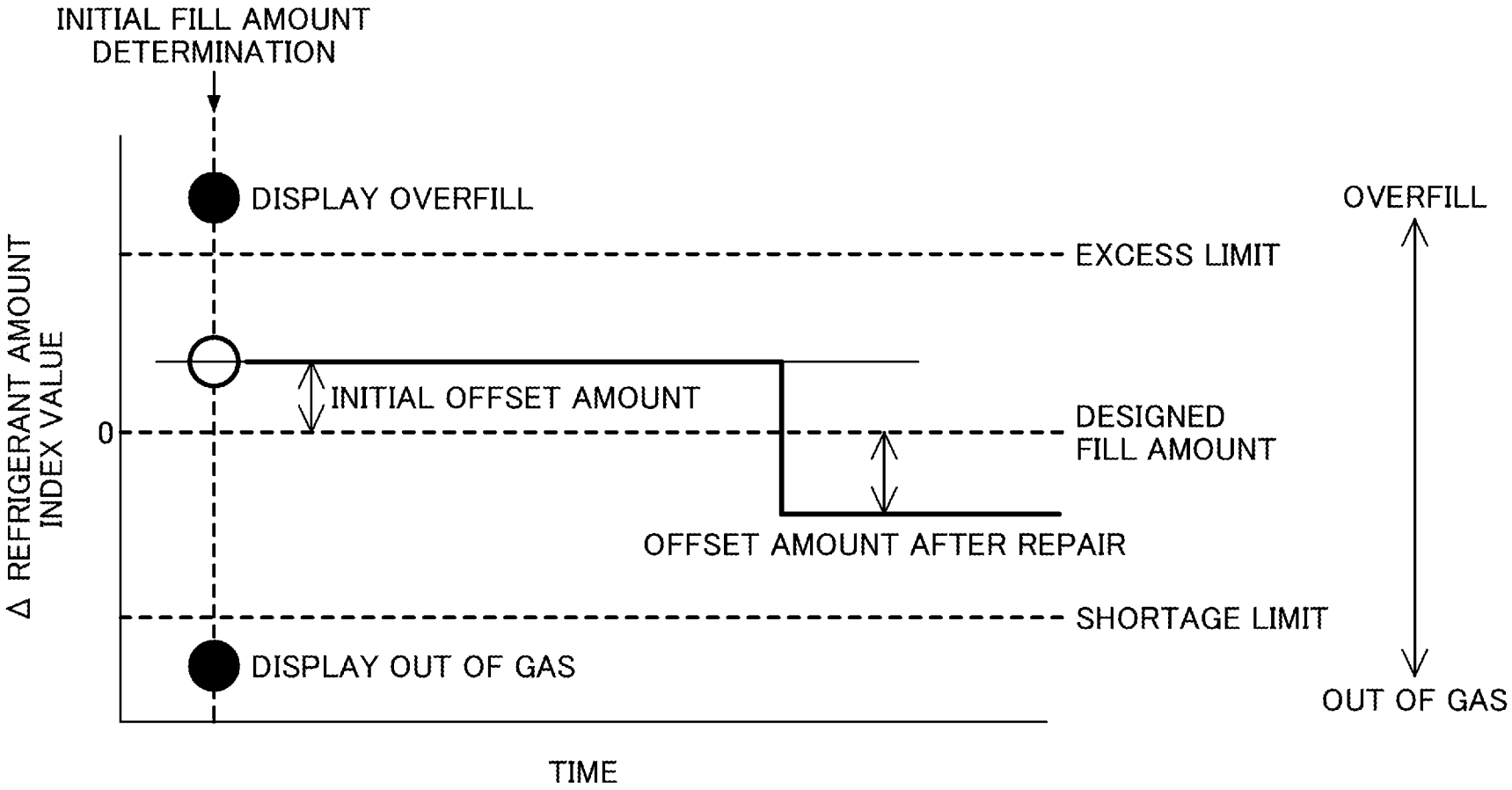
FIG. 21 is a diagram for explaining an output correction unit according to an embodiment of the present disclosure.

FIG. 21 is a diagram for explaining the output correction unit according to an embodiment of the present disclosure. The output correction unit may correct an offset amount between: the refrigerant amount index value when the refrigerant amount is a designed value; and the measured value of the refrigerant amount index value. For example, in multi-air conditioners for buildings, additional filling is carried out locally according to the connection pipe. In this case, an offset occurs between the actual filled amount and the designed filled amount due to errors in the calculation of the additional filled amount and the filling operation. In addition, learning has been performed so that the difference in the refrigerant amount index value to be zero by the designed filled amount. Therefore, immediately after installation, the offset amount is corrected so that the difference in the refrigerant amount index value becomes zero. Also, when the refrigerant amount is adjusted by replacing the compressor and the like during operation, an offset occurs between the values before and after repair. Therefore, the offset amount is re-corrected with the input of SE and the like after repair as a trigger.

The output correction unit determines the AI output characteristics such as an initial filled amount (offset amount), a refrigerant leakage rate (the rate of change of AI output) and the like. The calculating unit 402 and the inferring unit 403 (including the correction model 406) are also referred to as artificial intelligence (AI). The output correction unit can reduce erroneous determination by selecting the optimum decision logic according to the characteristics. In addition, the output correction unit determines AI output characteristics such as the initial filled amount (offset amount) and the refrigerant leakage rate (the rate of change of AI output) and changes AI according to the characteristics in order to reduce erroneous determination. For example, when it is determined from the output characteristics of AI-1 that the property is out of gas, the AI can be changed to AI-2 with high accuracy for properties that are running out of gas.

«Input Correction»

The refrigerant amount determining device 400 may further include an input correction unit for correcting the operation data.

Figure 22:
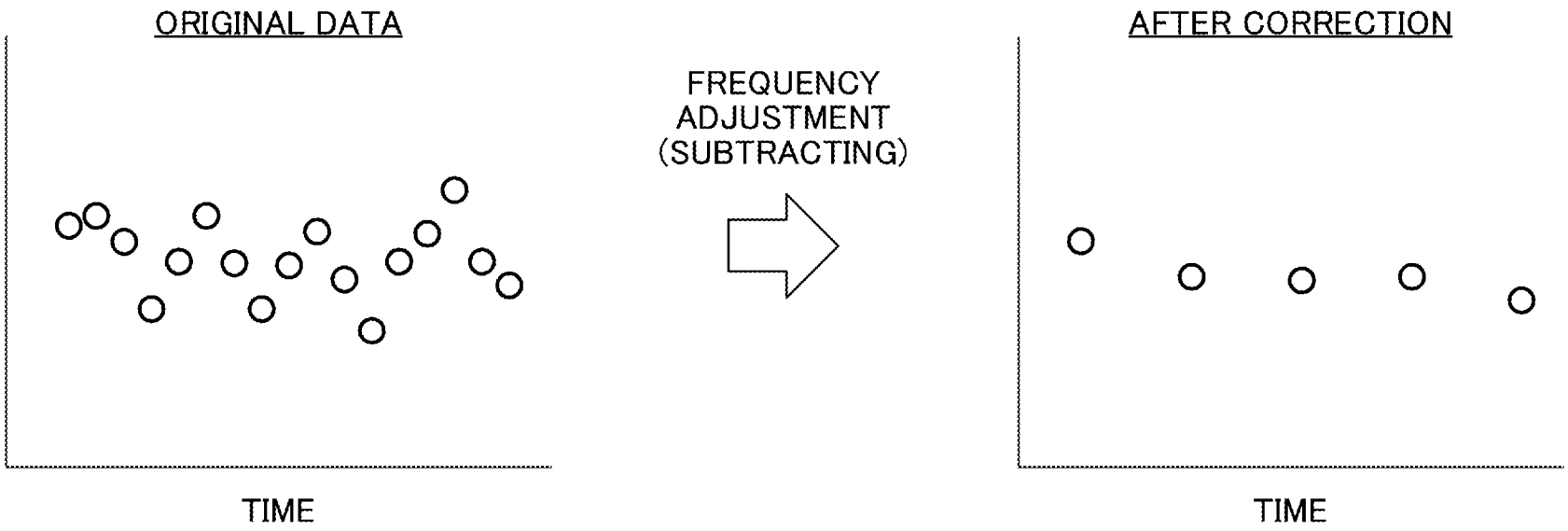
FIG. 22 is a diagram for explaining an input correction unit according to an embodiment of the present disclosure.
Figure 23:
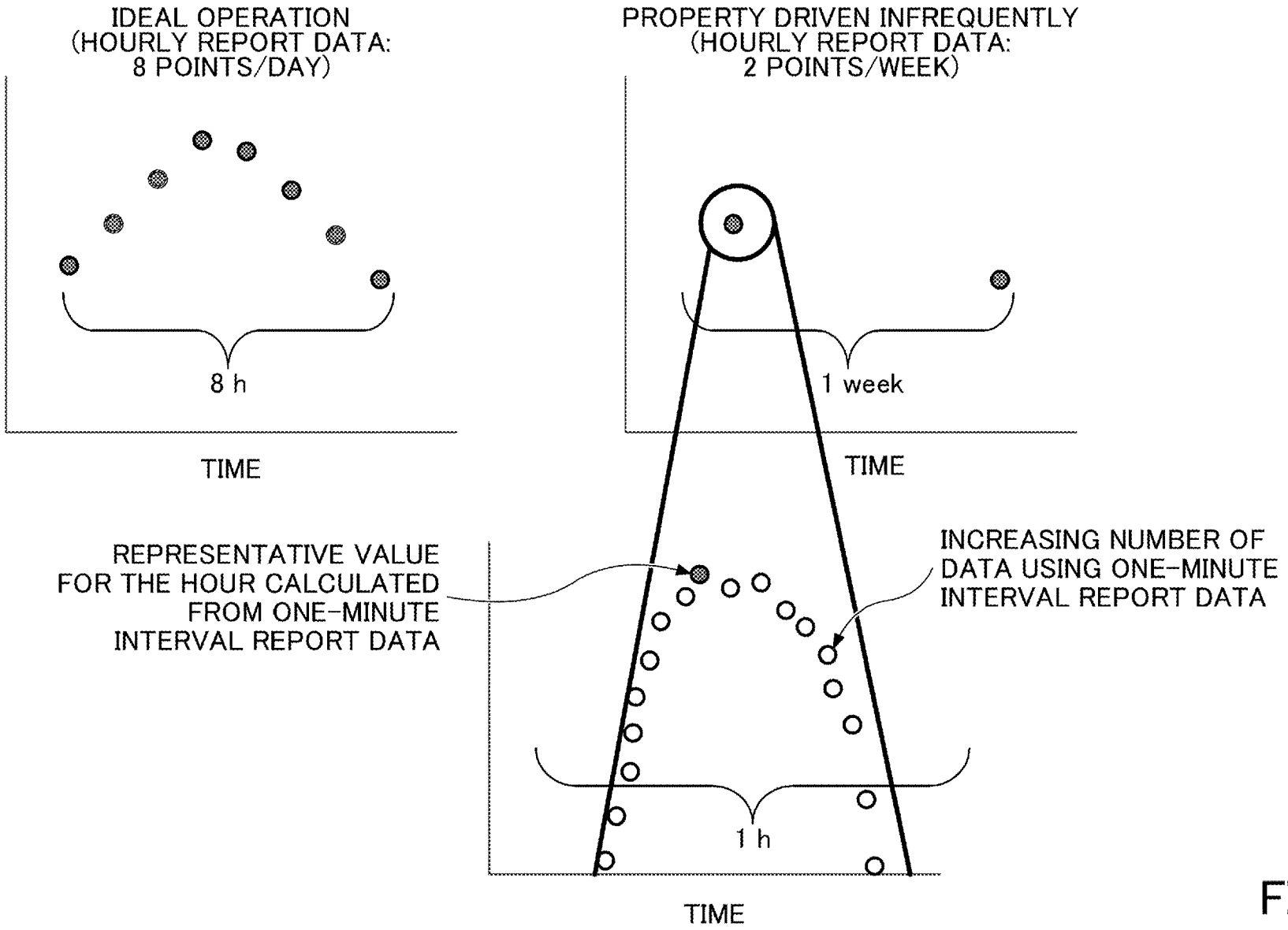
FIG. 23 is a diagram for explaining the input correction unit according to an embodiment of the present disclosure.

FIGS. 22 and 23 are diagrams for explaining the input correction unit according to an embodiment of the present disclosure. The input correction unit may increase or decrease the acquisition interval of the operation data according to the number of pieces of the operation data. For example, as illustrated in FIG. 22, when the operation data is used for detection for other than leakage (detection for other fault), the sampling interval is determined at a level at which all applications may be used without difficulty. When the original data is supplied at a frequency above the level required for leakage detection, the use of all data will cause a greater variation in the refrigerant amount index value, making it difficult to handle. Therefore, it may be used with the appropriate data interval for leakage detection. For example, as illustrated in FIG. 23, when the original data is obtained at intervals of one minute, one hourly report data after subtracting the original report data may be used for the leakage detection. The daily report data at intervals of one minute may be stored in a buffer. When the hourly report data after subtracting is found to be insufficient, the number of data may be increased by using the original report data.

The input correction unit may exclude data from AI inputting when the data quality deteriorates, such as short operation time, high start/stop frequency, or small number of indoor units in operation, in order to prevent erroneous determination. In addition, the input correction unit may select the optimum AI according to features such as a small number of data within a certain period of time, a low outdoor temperature, and a small frequency of the compressor.

The input correction unit may create pseudo data of the operation data. The operation data may include at least one of the measured data and the pseudo data.

The refrigerant amount determining device 400 may further include the output correction unit and the input correction unit.

<Determination Result>

For example, the outputting unit 405 may output a numerical value for determining the refrigerant amount (for example, a corrected difference between the refrigerant amount index value and the predicted value=0; SC=0.5) as the determination result. That is, the determining unit 404 determines the current precise trend value in which the variation or noise is removed from the refrigerant amount index value.

For example, the outputting unit 405 may output a category for determining the refrigerant amount (for example, leakage/normal, level A/B/C) or a category for determining the refrigerant amount and its reliability (for example, "leakage; reliability 85%") as a result of the determination. That is, the determining unit 404 determines whether there is a leakage condition at the present time based on the value obtained by removing variation or noise from the refrigerant amount index value.

<Feedback Of Determination Result>

The determination result may be fed back as follows.

The determination result may be fed back to the determining unit 404. The determining unit 404 may perform the determination using the determination result output by the outputting unit 405. For example, the determining unit 404 may make a first-order determination using its own logic and finally determine by adding the determination result based on past similar conditions referenced from the database. For example, the determining unit 404 may readjust the determination conditions or threshold so as to reduce erroneous determination and improve the correct answer rate based on the determination result within a certain period after detecting the leakage by the default setting (the determining unit 404 may regularly readjust in the same method thereafter). As described above with reference to FIG. 9, when the input item is not completely corrected, the determining unit 404 may determine the refrigerant amount of the air conditioning system based on both the difference or ratio between "the refrigerant amount index value calculated by the calculating unit 402" and "the predicted value of the refrigerant amount index value at the normal operation inferred by the inferring unit 403" or the difference or ratio between "the refrigerant amount index value calculated from the operating conditions when the operation data for calculating the refrigerant amount index value were obtained and from the past operation data that was obtained when the operating conditions were in a predetermined range" and "the predicted value of the refrigerant amount index value at the normal operation inferred by the inferring unit 403".

The determination result may be fed back to the learned model acquiring unit 407. The learned model acquiring unit 407 may obtain an optimum correction model using the determination result output by the outputting unit 405. For example, the learned model acquiring unit 407 may reacquire the learned model based on the determination result within a certain period after detecting the leakage in the default setting model so that the erroneous determination decreases and the correct answer rate increases.

The determination result may be fed back to the learning unit 503. The learning unit 503 may relearn using the determination result output by the outputting unit 405. For example, the learning unit 503 may create a model that has relearned from the determination result within a certain period after detecting leakage in a default setting model so as to reduce the erroneous determination and improve the correct answer rate.

The determination result may be fed back to the learning dataset. The learning unit 503 may modify the learning data using the determination result output by the outputting unit 405 and relearn the correction model. For example, the learning unit 503 may modify the learning dataset to generate a model relearned from the determination result within a certain period after detecting leakage in a default setting model so as to reduce the erroneous determination and improve the correct answer rate.

«External Data»

In the above, only the operation data is used, but the operation data and external data (for example, external sensor data, image data, and installation status data of the air conditioning system 100) may be used.

For example, the correction model is a model learned by associating the external sensor data, the operation data, and the refrigerant amount index with one another. The operation data acquiring unit 401 further acquires the external sensor data. The inferring unit 403 infers information regarding correction of the refrigerant amount index value using the acquired external sensor data, the operation data, and the correction model. For example, the external sensor data is data of the temperature and pressure sensor (when the sensor that measures the temperature and pressure data is not mounted). For example, the external sensor data is data from a refrigerant gas leakage detection sensor. For example, the external sensor data may be data from a vibration sensor and acceleration pickup.

For example, the correction model is a model learned by associating image data, the operation data, and the refrigerant amount index with one another. The operation data acquiring unit 401 further acquires the image data. The inferring unit 403 infers information regarding correction of the refrigerant amount index value using the acquired image data, the operation data, and the correction model. The image data is image data of the point where a change appears when the refrigerant leaks. For example, the image data is image data of the sight glass installed in the middle of the liquid pipe from the outlet of the condenser to the expansion valve (image data of the generation of bubbles caused by saturation in the pipe due to a low refrigerant amount). For example, the image data is an image taken by injecting a fluorescent agent into a pipe and emitting black light on a part where leakage is likely to occur. For example, the image data is an image of the frost formation on the surface of the outdoor unit heat exchanger fin during heating.

For example, the correction model is a model learned by associating the installation status data of the air conditioning system 100, the operation data, and the refrigerant amount index with one another. The operation data acquiring unit 401 further acquires the installation status data of the air conditioning system 100. The inferring unit 403 infers information regarding correction of the refrigerant amount index value using the acquired installation status data, the operation data, and the correction model. For example, the installation status data of the air conditioning system 100 is the overall length of the pipe, the ratio of the length of the main pipe to the length of the branch pipe, the difference in the installation height between the outdoor unit and the indoor unit, the indoor unit structure (which causes a difference in the indoor unit volume), and the like.

For example, the installation status data of the air conditioning system 100 is filled amount of the refrigerant. By using data on standard refrigerant amount and in-short refrigerant amount when creating a model, it is possible to predict refrigerant amount at the normal operation and at the leakage from the operation data.

While the embodiments have been described, it will be understood that various modifications of embodiments and details are possible without departing from the spirit and scope of the claims.

The present application claims the priority to Japanese Patent Application No. 2019-163572, filed on Sep. 9, 2019, with the Japanese Patent Office, the entire contents of which are hereby incorporated by reference.

100 Air conditioning system
200 Outdoor unit
201 Outdoor heat exchanger
202 Compressor
203 Subcooling heat exchanger
204 Subcooling heat exchanger expansion valve
205 Outdoor unit main expansion valve
300 Indoor unit
301 Indoor heat exchanger
302 Indoor heat exchanger expansion valve
400 Refrigerant amount determining device
201-1 Outdoor heat exchanger (condenser)
201-2 Outdoor heat exchanger (evaporator)
300-1 Heating indoor unit
300-2 Cooling indoor unit
401 Operation data acquiring unit
402 Calculating unit
403 Inferring unit
403-1 Correction unit
403-2 Past value
404 Determining unit
405 Outputting unit
406 Learned model
407 Learned model acquiring unit
500 Learning device
501 Teacher data acquiring unit
502 Teacher data storage unit
503 Learning unit
1300 Subcooling heat exchanger gas pipe
1400 Economizer
1401 Expansion valve for economizer
1402 Main expansion valve
1403 Condenser
1404 Evaporator
1500 Expansion valve for intermediate injection
1501 Condenser
1502 Evaporator

The invention claimed is:

1. A refrigerant amount determining device comprising:

a memory; and a processor coupled to the memory and configured to:

acquire operation data of an air conditioning system;

calculate a refrigerant amount index value from the operation data acquired;

input at least one of the acquired operation data or the calculated refrigerant amount index value into a correction model to obtain information regarding correction of the refrigerant amount index value, wherein the information regarding correction of the refrigerant amount index value is obtained by any one of:

(i) calculating, as the information regarding correction of the refrigerant amount index value, an inner product of the calculated refrigerant amount index value at a plurality of dates and a refrigerant amount index value at the same plurality of dates in a previous year, by inputting both the refrigerant amount index values into the correction model;

(ii) inputting second operation data that is included in the acquired operation data into, the correction model to:obtain, a predicted value of a range of a refrigerant amount index value, the second operation data being at least partially different from first operation data that is included in the acquired operation data and is used for calculating the refrigerant amount index value, or the second operation data being at least partially identical to the first operation data, and determining, as the information regarding correction of the refrigerant amount index value. an evaluation result whether the calculated refrigerant amount index value is within the predicted value of the range of the refrigerant amount index value; and (iii) inputting the second operation data into the correction model to obtain a predicted value of a refrigerant amount index value, and obtaining, as the information regarding correction of the refrigerant amount index value, a difference or ratio between the calculated refrigerant amount index value and the predicted value of the refrigerant amount index value; and output, based on the information regarding correction of the refrigerant amount index value, at least one selected from a group including: presence or absence of leakage of a refrigerant; degree of the leakage of the refrigerant; a ratio:of a leakage amount to an appropriate amount of the refrigerant; a refrigerant amount; and the difference or ratio between the calculated refrigerant amount index value and the predicted value of the refrigerant amount index value, regarding the air conditioning system, wherein the processor is configured to increase or decrease an acquisition interval of the operation data according to a number of pieces of the operation data.

2. The refrigerant amount determining device according to claim 1, wherein the processor is configured to infer a corrected refrigerant amount index value in which the calculated refrigerant amount index value is corrected, using the calculated refrigerant amount index value and the correction model, and the processor is configured to output based on the corrected refrigerant amount index value.

3. The refrigerant amount determining device according to claim 2, wherein one or more refrigerant amount index value and one or more correction model is used.

4. The refrigerant amount determining device according to claim 1, wherein the correction model is a model learned by associating the refrigerant amount index value with the first operation data at either normal operation, abnormal operation. or both.

5. The refrigerant amount determining device according to claim 4, wherein the first operation data at either normal operation, abnormal operation. or both includes at least one of measured data and pseudo data.

6. The refrigerant amount determining device according to claim 1, the processor is further configured to correct the information regarding correction of the refrigerant amount index value.

7. The refrigerant amount determining device according to claim 6, wherein the processor is configured to correct an offset amount between: the refrigerant amount index value when the refrigerant amount is a designed value; and the measured value of the refrigerant amount index value.

8. The refrigerant amount determining device according to claim 1, the processor is further configured to correct the first operation data.

9. The refrigerant amount determining device according to claim 8, wherein the first operation data includes at least one of measured data or pseudo data, and the processor is configured to create pseudo data of the first operation data.

10. The refrigerant amount determining device according to claim 1, the processor is further configured to output a reliability of an output.

11. The refrigerant amount determining device according to claim 1, the processor is further configured to acquire a correction model that is a result of learning in which the first operation data and the refrigerant amount index value are associated with each other.

12. The refrigerant amount determining device according, to claim 1, wherein the processor is configured to acquire an optimum correction model with reference to erroneous determination or a correct answer rate of the output.

13. The refrigerant amount determining device according to claim 1, the processor is further configured to learn by associating the first operation data and the refrigerant amount index value with each other.

14. The refrigerant amount determining device according to claim 13, wherein the processor is configured to relearn using a content of the output.

15. The refrigerant amount determining device according to claim 13, wherein the processor is configured to change the learning data using the content of the output and relearn the correction model.

16. The refrigerant amount determining device according to claim 1, wherein the correction model is a model learned by associating external sensor data, the first operation data, and a refrigerant amount index with one another, the processor is configured to further acquire external sensor data, and the processor is configured to infer the information regarding correction of the refrigerant amount index value using the acquired external sensor data, the first operation data, and the correction model.

17. The refrigerant amount determining device according to claim 1, wherein the correction model is a model learned by associating image data, the first operation data, and a refrigerant amount index with one another, the processor is configured to further acquire image data, and the processor is configured to infer the information regarding correction of the refrigerant amount index value using the acquired image data, the first operation data, and the correction model.

18. The refrigerant amount determining device according to claim 1, wherein the correction model is a model learned by associating installation status data of the air conditioning system, the first operation data, and a refrigerant amount index with one another, the processor is configured to further acquire installation status data, and the processor is configured to infer the information regarding correction of the refrigerant amount index value using the acquired installation status data, the first operation data, and the correction model.

19. The refrigerant amount determining device according to claim 1, wherein the first operation data includes at least one of outdoor temperature, a rotation speed of a compressor, an opening degree of an expansion valve of a subcooling heat exchanger, and a value of current of the compressor.

20. The refrigerant amount determining device according to claim 1, wherein the refrigerant amount, index value includes at least one of a degree of subcooling at an outdoor heat exchanger outlet; a degree of superheating in suction of a compressor; a degree of superheating in discharge of the compressor; and a value based on the degree of subcooling at the outdoor heat exchanger outlet, the degree of superheating, in suction of the compressor, or the degree of superheating in discharge of the compressor.

21. The refrigerant amount determining device according to claim 1, wherein the refrigerant amount index value includes at least one of a degree of subcooling at a subcooling heat exchanger outlet and a value based on the degree of subcooling at the subcooling heat exchanger outlet.

22. The refrigerant amount determining device according to claim 1, wherein the refrigerant amount index value includes at least one of a degree of subcooling at an indoor heat exchanger outlet and -a value based on the degree of subcooling at the indoor heat exchanger outlet, the degree of subcooling at the indoor heat exchanger outlet is any one of at least one of the degree of subcooling of indoor heat exchangers; an average value of the indoor heat exchangers; or a degree of subcooling at an indoor or outdoor confluence of the indoor heat exchangers.

23. The refrigerant amount determining device according, to claim 20, wherein the refrigerant amount index value is a combination of a degree of subcooling at an indoor heat exchanger outlet of a simultaneous cooling and heating operation device in a heating operation mode and a degree of subcooling at an outdoor heat exchanger outlet, functioning as condenser, of the simultaneous cooling and heating operation device.

24. The refrigerant amount determining device according to claim 1, wherein the, first, operation data includes at least one of:

opening degree of an indoor unit expansion valve,
opening degree of an outdoor unit main expansion valve,
total value of rated power of an indoor unit during operation or standby,
number of indoor units in operation,
power of the indoor unit (cooling or heating),
blowout temperature of the indoor unit,
room temperature,
condensation temperature,
evaporation temperature,
refrigerant temperature of an outdoor unit liquid shutoff valve connection pipe,
refrigerant temperature of a liquid connection pipe,
flow rate of an outdoor unit fan,
flow rate of an indoor unit fan,
rotation speed of the outdoor unit fan,
rotation speed of the indoor unit fan,
value of current of the outdoor unit fan,
value of current of the indoor unit fan,
discharge temperature of a compressor,
suction temperature of the compressor,
degree of superheating in discharge of the compressor,
degree of superheating in suction of the compressor,
degree of subcooling at a subcooling heat exchanger outlet,
degree of superheating at the subcooling heat exchanger outlet (a gas pipe side),
degree of subcooling at an economizer outlet,
opening degree of an expansion valve for an economizer,
outlet pressure of the economizer bypass side,
opening degree of the expansion valve for intermediate injection,
intermediate injection temperature,
intermediate injection pressure,
water temperature of an evaporator inlet,
water temperature of an evaporator outlet,
water temperature of a condenser inlet, or
water temperature of a condenser outlet.

25. The refrigerant amount determining device according to claim 22, wherein the first operation data includes at least one of a number of times of defrosting, or duration of defrosting.

26. The refrigerant amount determining device according to claim 1 wherein the'processor is, configured to output the refrigerant amount of the air conditioning system based on both a difference or ratio between: the calculated refrigerant amount index value; and an inferred predicted value of the refrigerant amount index value at a normal operation, and a difference or ratio between: the refrigerant amount index value calculated from an operating condition when the first operation data for calculating the refrigerant amount index value was acquired and from past operation data that was acquired when an operating condition was in a predetermined range; and an inferred predicted value of the refrigerant amount index value at a normal operation.

27. The refrigerant amount determining device according to claim 26, wherein the operating condition is an outdoor temperature.

28. The refrigerant amount determining device according to claim 1, wherein the processor is configured to output the ratio of the leakage amount to the appropriate amount of the refrigerant of the air conditioning system based on a difference or ratio between the calculated refrigerant amount index value and an inferred predicted value of the refrigerant amount index value at a normal operation.

29. A method comprising:

acquiring operation data of an air conditioning system;

calculating a refrigerant amount index value from the operation data acquired;

inputting at least one of the acquired operation data or the calculated refrigerant amount index value into a correction model to obtain information regarding correction of the refrigerant amount index value, wherein the information regarding correction of the refrigerant amount index value is obtained by any one of:

(i) calculating, as the information regarding correction of the refrigerant amount index value, an inner product of the calculated refrigerant amount index value at a plurality of dates and a refrigerant amount index value at the same plurality of dates in a previous year, by inputting both the refrigerant amount index values into the correction model;

(ii) inputting second operation data that is included in the acquired operation data into the correction model to obtain a predicted value of a range of a refrigerant amount index value, the second operation data being at least partially different from first operation data that is included in the acquired operation data and is used for calculating the refrigerant amount index value, or the second operation data being at least partially identical to the first operation data, and determining, as the information regarding correction of the refrigerant amount index value, an evaluation result whether the calculated refrigerant amount index value is within the predicted value of the range of the refrigerant amount index value; and (iii) inputting the second operation data into the correction model to obtain a predicted value of a refrigerant amount index value, and obtaining, as the information regarding correction of the refrigerant amount index value, a difference or ratio between the calculated refrigerant amount index value and the predicted value of the refrigerant amount index value;

outputting, based on the corrected refrigerant amount index value, at least one selected from a group including: presence or absence of leakage of a refrigerant: degee of the leakage of the refrigerant; a ratio of a leakage amount to an appropriate amount of the refrigerant; a refrigerant amount; and the difference or ratio between the calculated refrigerant amount index value and the predicted value of the refrigerant amount index value, regarding the air conditioning system; and increasing or decreasing an acquisition interval of the operation data according to a number of pieces of the operation data.

30. A non-transitory computer-readable recording medium storing a program for causing a refrigerant amount determining device to:

acquire operation data of an air conditioning system;

calculate a refrigerant amount index value from the operation data acquired;

input at least one of the acquired operation data or the calculated refrigerant amount index value into a correction model to obtain information regarding correction of the refrigerant amount index value, wherein the information regarding correction of the refrigerant amount index value is obtained by any one of:

(i) calculating, as the information regarding correction of the refrigerant amount index value, an inner product of the calculated refrigerant amount index value at a plurality of dates and a refrigerant amount index value at the same plurality of dates in a previous year, by inputting both the refrigerant amount index values into the correction model;

(ii) inputting second operation data that is included in the acquired operation data into the correction_model to obtain a predicted value of a range of a refrigerant amount index value, the second operation data being at least partially different from first operation data that is included in the acquired operation data and is used for calculating the refrigerant amount index value, or the second operation data being at least partially identical to the first operation data, and determining, as the information regarding correction of the refrigerant amount index value. an evaluation result whether the calculated refrigerant amount index value is within the predicted value of the range of the refrigerant amount index value; and (iii) inputting the second operation data into the correction model to obtain a predicted value of a refrigerant amount index value, and obtaining, as the information regarding correction of the refrigerant amount index value, a difference or ratio between the calculated refrigerant amount index value and the predicted value of the refrigerant amount index value;

output, based on the corrected refrigerant amount index value, at least one selected from a group including: presence or absence of leakage of a refrigerant; degree of the leakage of the refrigerant; a ratio of a leakage amount to an appropriate amount of the refrigerant; a refrigerant amount: and the difference or ratio between the calculated refrigerant amount index value and the predicted value of the refrigerant amount index value, regarding the air conditioning system; and increase or decrease an acquisition interval of the operation data according to a number of pieces of the operation data.

* * * * *